US006732822B2

(12) United States Patent
Slack et al.

(10) Patent No.: US 6,732,822 B2
(45) Date of Patent: May 11, 2004

(54) METHOD AND APPARATUS FOR HANDLING TUBULAR GOODS

(75) Inventors: Maurice William Slack, Edmonton (CA); Trent Michael Victor Kaiser, Edmonton (CA); Daniel Mark Shute, Beaumont (CA)

(73) Assignee: Noetic Engineering Inc., Edmonton (CA)

( * ) Notice: Subject to any disclaimer, the term of this patent is extended or adjusted under 35 U.S.C. 154(b) by 0 days.

(21) Appl. No.: 10/239,454

(22) PCT Filed: Mar. 22, 2001

(86) PCT No.: PCT/CA01/00375

§ 371 (c)(1),
(2), (4) Date: Feb. 26, 2003

(87) PCT Pub. No.: WO01/71154

PCT Pub. Date: Sep. 27, 2001

(65) Prior Publication Data

US 2003/0155159 A1 Aug. 21, 2003

(30) Foreign Application Priority Data

Mar. 22, 2000 (CA) ..... 2301963

(51) Int. Cl.[7] ..... E21B 19/10

(52) U.S. Cl. ..... 175/423; 294/86.25; 294/95; 166/138; 166/216

(58) Field of Search ..... 175/423; 279/213; 294/86.25, 86.24, 86.21, 86.29, 93, 94, 95; 166/138, 98, 78.1, 216, 119, 237

(56) References Cited

U.S. PATENT DOCUMENTS

| | | | | |
|---|---|---|---|---|
| 1,843,537 A | | 2/1932 | Bickerstaff | |
| 3,697,113 A | | 10/1972 | Palauro et al. | 294/86.24 |
| 3,747,675 A | | 7/1973 | Brown | 166/237 |
| 4,044,581 A | * | 8/1977 | Meserole | 72/68 |
| 4,327,776 A | * | 5/1982 | Meserole | 138/109 |
| 4,685,518 A | * | 8/1987 | Claycomb | 166/243 |
| 4,726,423 A | * | 2/1988 | Claycomb | 166/380 |

FOREIGN PATENT DOCUMENTS

| | | | |
|---|---|---|---|
| EP | 0285386 | 10/1988 | E21B/19/16 |
| WO | WO 00/05483 | 2/2000 | E21B/19/16 |

* cited by examiner

*Primary Examiner*—Roger Schoeppel
(74) *Attorney, Agent, or Firm*—Christensen O'Connor Johnson Kindness PLLC

(57) ABSTRACT

An apparatus for handling tubular goods which includes an elongate body having a coupling end adapted for mating engagement with a tubular good. The coupling end includes a structural member, a flexible cylindrical cage and a pressure member. Longitudinal strips joined at their opposed ends form the cage coaxial with and connected to the structural member of the body. The coaxial pressure member is disposed in an annulus between the structural member and the cage. The pressure member is adapted to cause radial displacement of the cage, thereby exerting a gripping force to maintain the mating engagement between the tubular good and the coupling end enabling a transfer of force between the body and the tubular good.

14 Claims, 15 Drawing Sheets

METHOD AND APPARATUS FOR HANDLING TUBULAR GOODS

FIELD OF THE INVENTION

The manufacture, assembly and use of tubular systems in drilling and constructing wells, frequently involves operations where the tubular work piece must be gripped and handled to enable the application of axial and torsional loads. Devices employing jaws, such as elevators, tongs or pipe wrenches are commonly used to engage the pipe body directly, with the risk of damage by distortion of the pipe or marking by the jaw faces. Where the tubular ends are threaded, adapters may be used to temporarily engage the threads and transfer load running the risk of damaging the threads. The present invention provides a means to internally friction grip a tubular work piece with an expandable cage, and apply assembly, handling and drilling loads through an attachment.

BACKGROUND OF THE INVENTION

Historically, petroleum drilling rigs have used an architecture where drilling torque is applied through a rotary table placed in the derrick floor. The rig mast is used to support the block and tackle equipment for hoisting tubular strings comprised of individual joints of pipe connected by threaded connections, in and out of the drilled hole or well. With this architecture, it is inconvenient to use the rotary table to apply torque to make up or break out the connections. Tongs are therefore typically used to apply and react make up or break out torque, by externally gripping the pipe ends to be connected directly above and below the threaded connection. This well known procedure is used to make up and break out drill pipe, casing and tubing to trip tubular strings in or out of the well. In the case of casing and tubing, the method is typically incorporated into devices, referred to as power tongs, which provide a means to apply continuous rotation and torque through a motor and gear box assembly. However these devices still require external grips, typically using some form of jaws as described, for example, in U.S. Pat. No. 5,172,613. Whether powered or not, this method requires that one tong grip the upper end of the pipe joint suspended from the rotary table in the derrick floor, to provide a reaction for the torque applied through a second tong which is used to grip and rotate the pipe joint being made up or broken out. The upper end of the pipe joint being rotated is supported by an elevator, hanging from the travelling blocks, thus allowing rotation and providing limited freedom to translate laterally.

However recent advances in drilling rig technology have resulted in increased use of rigs having a new architecture, and known in the industry as top drive rigs. As the name suggests, these rigs are equipped with a hydraulic or electric drive head unit that moves up and down the rig mast constrained by a track, thus enabling the application of rotational force from any position. These rigs employ a drive head capable of applying torque and axial load to the top of the pipe through an output shaft known as a "quill," and typically employ more automated and powered pipe-handling equipment than conventional rigs. This configuration allows the tubulars to be made up and broken out using the top drive to rotate and apply torque to the top joint, but necessitates a method of coupling the quill to the tubular capable of transmitting full make up or break out torque and at least some axial load.

For tubing and casing, this is typically accomplished using a threaded make up adapter, commonly referred to as a "nubbin", threaded on the lower end to match the tubing or casing thread and on the upper end to match the thread on the quill. A device capable of stroking up and down and transmitting torque, commonly referred to as a floating cushion sub, is also often placed between the quill and the nubbin to accommodate thread make up and break out length change without top drive movement. This laterally rigid and flexurally stiff device effectively forms an extension of the quill.

Unlike the conventional make up and break out method using tongs, this method of top drive make up requires extra steps to handle, install and remove the nubbin, increasing the time and consequently, the cost of running tubulars. In addition, the risk of thread damage is increased by the extra make up and break out to the nubbin required for each joint run in or out of the well.

This method of top drive make up further exacerbates the potential for connection thread damage because the rigid lateral positioning of the top drive at the top end of the joint, where it is supported during rotation. This prevents the tendency of the thread axis to "self align" as otherwise occurs when the top of the joint is suspended from the cable-supported travelling block on conventional rigs, allowing relatively free lateral movement. Although the axes of the pin and box threads are generally parallel when the connection is stabbed, tolerances for rig mast position with respect to the hole axis, pipe straightness and threading can all conspire to allow significant misalignment. Under these conditions, the potential for connection damage is aggravated by alignment constraints as imposed by relatively rigid support at the upper end of joints. Contrast this with the greater freedom of motion allowed on conventional rigs when the travelling block supports the upper end of the pipe. During rotation of the connection at the lower end, this alignment constraint tends to prevent the pin and box thread axes from self aligning which results in a tendency toward 'cross threading' of the connection when significant tolerancing errors exist, with consequent high internal contact stress and galling susceptibility. In many instances known to the inventors, this misalignment has resulted in connection damage and improperly made-up connections.

It is therefore desirable to have a method for gripping the pipe without contacting the threads and that allows the top end of the pipe to displace laterally with relative freedom.

Methods using jaws on the exterior of the pipe to apply torque without contacting the threads are numerous. As mentioned above, jaws are typically employed with power tongs. Torque activated jaws such as described in U.S. Pat. No. 5,172,613, are the most typical architecture but the tendency of this method to mark and damage the pipe has led to more controlled active gripping systems such as described in U.S. Pat. No. 5,172,613. To further avoid "causing surface damage or structural deformation", more nearly uniformly radial loading, friction grips, such as described in U.S. Pat. No. 4,989,909 are known as a means to grip the exterior of tubulars where tolerance to damage is low. While these methods provide a generally satisfactory means for gripping the exterior of pipe, they are not amenable to use in conjunction with a top drive. Gripping the interior of the pipe avoids the need to apply torque through the coupling, or to invoke more complex means to bypass the connection, while all the time avoiding interference with other pipe handling equipment, such as elevators. Neither do these methods address intolerance to connection thread misalignment, which is peculiar to the top drive make up and break out method.

The device/method of the present invention was therefore conceived specifically as a means to friction grip the inside of the tubular and thus provide the capacity to transfer torque and carry most of the axial handling loads presently provided by nubbins. It will also shorten the handling time requirements, eliminate nubbin contact with the threads, and provide increased lateral compliance to accommodate the tendency for top end of the pipe to move off axis during make up.

SUMMARY OF THE INVENTION

To meet these objectives, the method of the present invention makes use of a device having an upper end provided with a crossover sub to attach to the quill and having a lower coupling end provided with a grip assembly, which may be inserted into the top end of a tubular work piece to be handled, and expanded to engage or grip the inside surface of the tubular joint. The grip method and contacting element preferably frictionally engage the inside wall of the tubular with a uniform distribution of radial loading virtually eliminating the risk of marking or distorting the pipe or connection. It will be understood that such attachment to the top drive quill may be direct or indirect to other intermediate components of the drill string such as a 'thread saver sub' essentially forming an extension of the quill.

The upper adapter is coupled to the grip assembly by means of a tube having upper and lower universal joints which enable lateral movement during transmission of torque, as is commonly employed in applications where torque is transmitted over some length, such as in automobile drive shafts flexibly coupled through universal joints. The grip assembly is further arranged to permit the grip to be activated, or set, by application of right hand torque and deactivated or released by application of left hand torque when a first operating mode is engaged. In a second operating mode, either left or right hand torque is transferred directly through the grip without changing the grip force. The first or setting mode is engaged by application of slight axial compressive load, or by setting the quill down. The second or direct torque mode is engaged by application of slight tension or by lifting the quill up once the grip is set. These simple, fast and direct means of gripping and releasing provide substantial operational improvements over the existing methods.

The primary purpose of the present invention is to provide a method employing an internal gripping device for handling tubular work pieces in general and particularly suited to perform make up and break out of pipe joints being run in or out of a well with a top drive drilling rig, having as its gripping mechanism a sub-assembly comprised of:

1. a generally cylindrical expandable cage with upper and lower ends,
2. a structural member is provided in the form of a mandrel. Mandrel has upper and lower ends placed coaxially inside the cage where the lower ends of the mandrel and cage are attached, and where the external diameter of the cage is somewhat less than the internal diameter of the tubular work piece to be gripped, allowing the cage to be positioned within the tubular work piece,
3. a significant annular space between the inside surface of the cage and the outside surface of the mandrel,
4. a pressure member disposed in the lower interval of the annular space between the mandrel and cage as an expansion element and
5. means to activate the expansion element to cause the cage to expand and frictionally engage the inside surface of the tubular work piece with sufficient radial force to enable the mobilization of friction to transfer significant torque and axial load from the upper end of the mandrel through the cage to the tubular.

Said expandable cage of the gripping mechanism having a lower and upper end:

- is preferably comprised of a plurality of flexible strips aligned largely axially along the body of the cage and attached to cylindrical sleeves at each end of the cage,
- where the edges of adjacent strips are preferably profiled to provide interleaving tabs or fingers,
- which fingers permit cage expansion or radial displacement of the strips but tend to prevent cage twist or shear displacement between strips under torsion loading.

Said means to provide cage expansion is preferably provided by:

- a largely incompressible elastomeric material disposed in the lower interval of the annular space between the mandrel and cage,
- means to confine the ends of the elastomeric material and if necessary further means to confine the outer sides of the elastomeric material across gaps that may exist between adjacent edges of the cage strips to prevent excess extrusion of the elastomeric material when compressed, and
- means to axially compress the annular elastomeric material with sufficient force to cause the cage to expand and frictionally engage the inner surface of the tubular enabling transfer of torque and axial load from the upper end of the mandrel through the cage to the tubular.

An additional purpose of the present invention is to provide a tubular gripping and handling device having said gripping sub-assembly joined to an external load and torque application device, such as the quill of a top drive rig, through a load transfer member or drive shaft, flexibly coupled at each end where such flexible couplers function as universal joints enabling transfer of torque with little or no moment or lateral resistance.

This purpose is preferably realized by:

- providing a crossover sub configured to thread to the quill on its upper end and connect to a tubular or hollow drive shaft at its lower end,
- by means of pins engaging slots in the upper end of the drive shaft thus providing the function of a universal joint, where
- a similar slotted and pinned connection is provided to join the lower end of the drive shaft to the upper end of the gripping mechanism sub-assembly.

A further purpose of the present invention is to provide a means to flow fluid and apply pressure through the top drive adapter and into the tubular work piece being gripped. This purpose is realized by providing a flow path through the crossover sub, drive shaft and tool mandrel and is preferably augmented by provision of an internal cup seal, such as a packer or swab cup, attached to the lower end of the mandrel to prevent leakage into the annular space between the mandrel and inside surface of the tubular work piece.

In applications, where the lifting capacity of the frictional grip is insufficient to reliably support the hoisting loads required to run assembled tubular strings into or out of a well, the make up and break out functions provided by the tubular handling and gripping assembly, must be supplemented by the addition of hoisting equipment. In a manner well known to the industry, such hoisting equipment may be provided as elevators. However, to support applications where suitable elevators may not be available or convenient to use, it is a further purpose of the present invention to provide additional means to support hoisting loads, integral with the frictional grip device.

This purpose is realized by providing an external hoisting sub-assembly, which sub-assembly is comprised of:

a largely cylindrical hoisting sleeve coaxially placed outside the internal gripping subassembly having an upper end attached to the upper end of the internal gripping subassembly, a lower end extending downward to overlap an interval of the tubular work piece, typically to the lower end of the collar typically attached to the upper end of casing or tubing joints, and lower end configured with internal grooves, a plurality of jaw segments, preferably provided as a collet where the upper end of the collet fingers are attached, and the lower end of the collet fingers carry the jaw segments configured to mate on their interior with the outside surface of the tubular work piece and on their exterior with ribs engaging the internal grooves of the hoisting sleeve where the spring action of the collet is preferably arranged so the jaws tends to contact the work piece, where the mating ribs and grooves of the jaw and hoisting sleeve surfaces respectively tend to force the jaws inward under application of hoisting load, in the manner of slips, well known to the industry as a method of providing load transfer between hoisting equipment and tubular goods, and means to retract the jaws to facilitate disengaging from the tubular work piece, which means is preferably linked to the operation of the internal friction grip so that the jaws may only be retracted when the tool is not set or activated.

Figure 14:
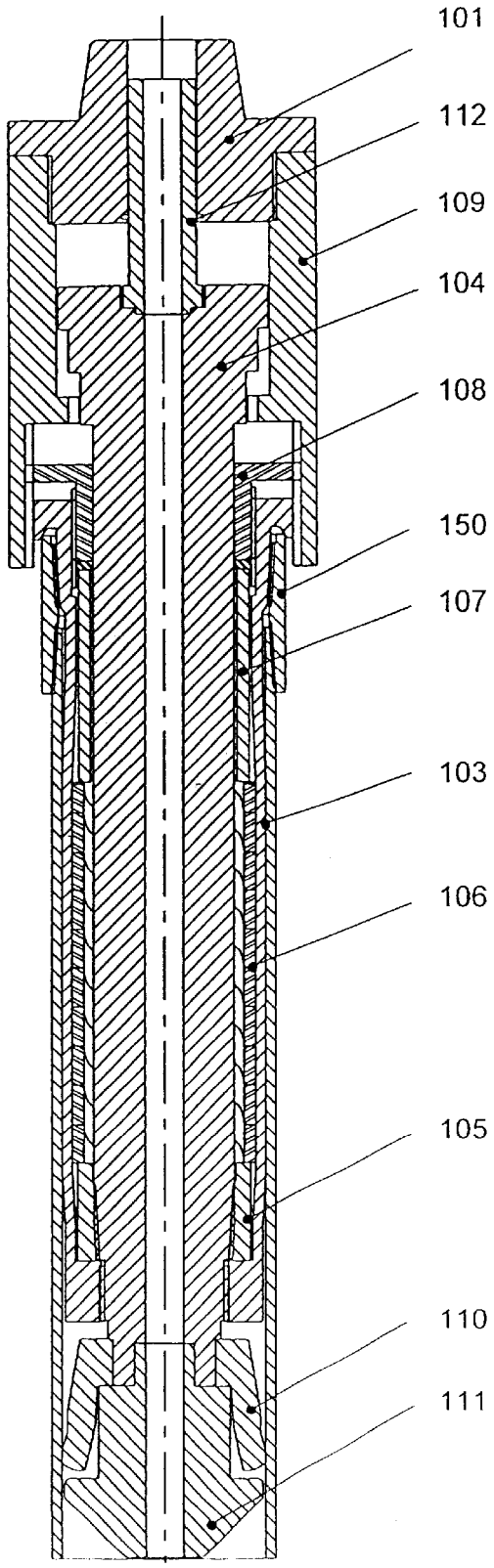
FIG. 14 Longitudinal cross-sectional view through the casing drive tool centre with the gripping assembly in setting mode showing cage expansion gripping the tubular work piece.
Figure 15:
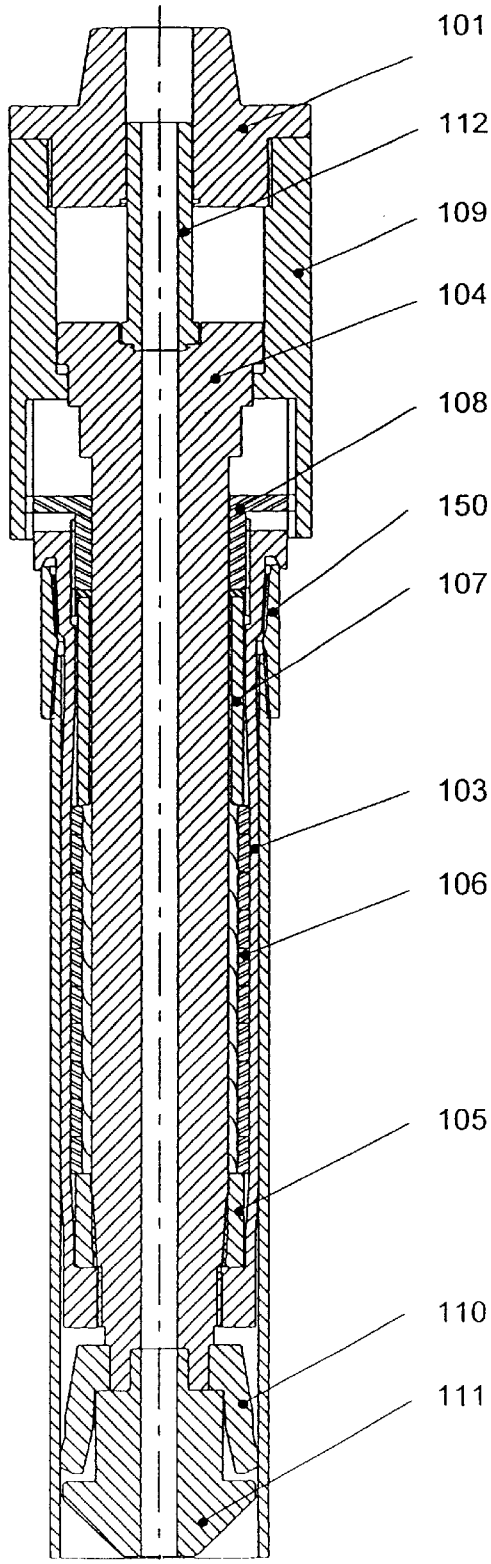
FIG. 15 Longitudinal cross sectional view through the casing drive tool centre with gripping assembly in torque mode showing cage expansion gripping the tubular work piece.
Figure 16:
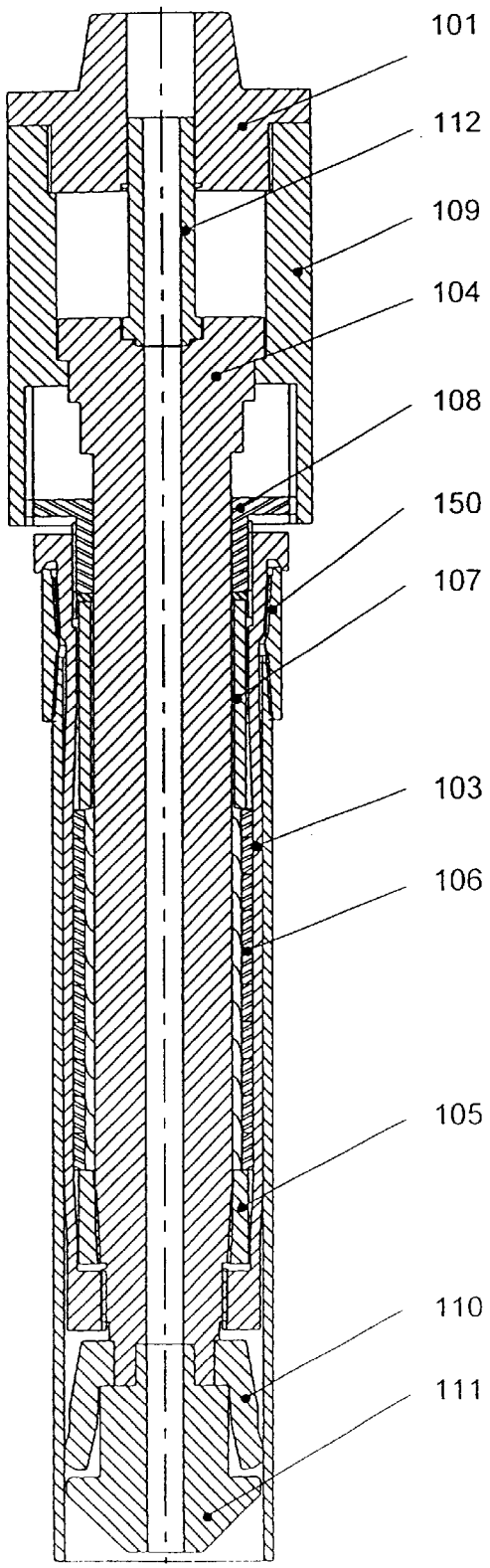
FIG. 16 Longitudinal cross sectional view through the centre of the casing drive tool with tool set and in torque mode showing tool position hoisting the tubular work piece.

The aspect ratio of the drawings shown in FIGS. 14, 15 and 16 has been adjusted to exaggerate the width.

DESCRIPTION OF THE PREFERRED EMBODIMENTS

Figure 1:
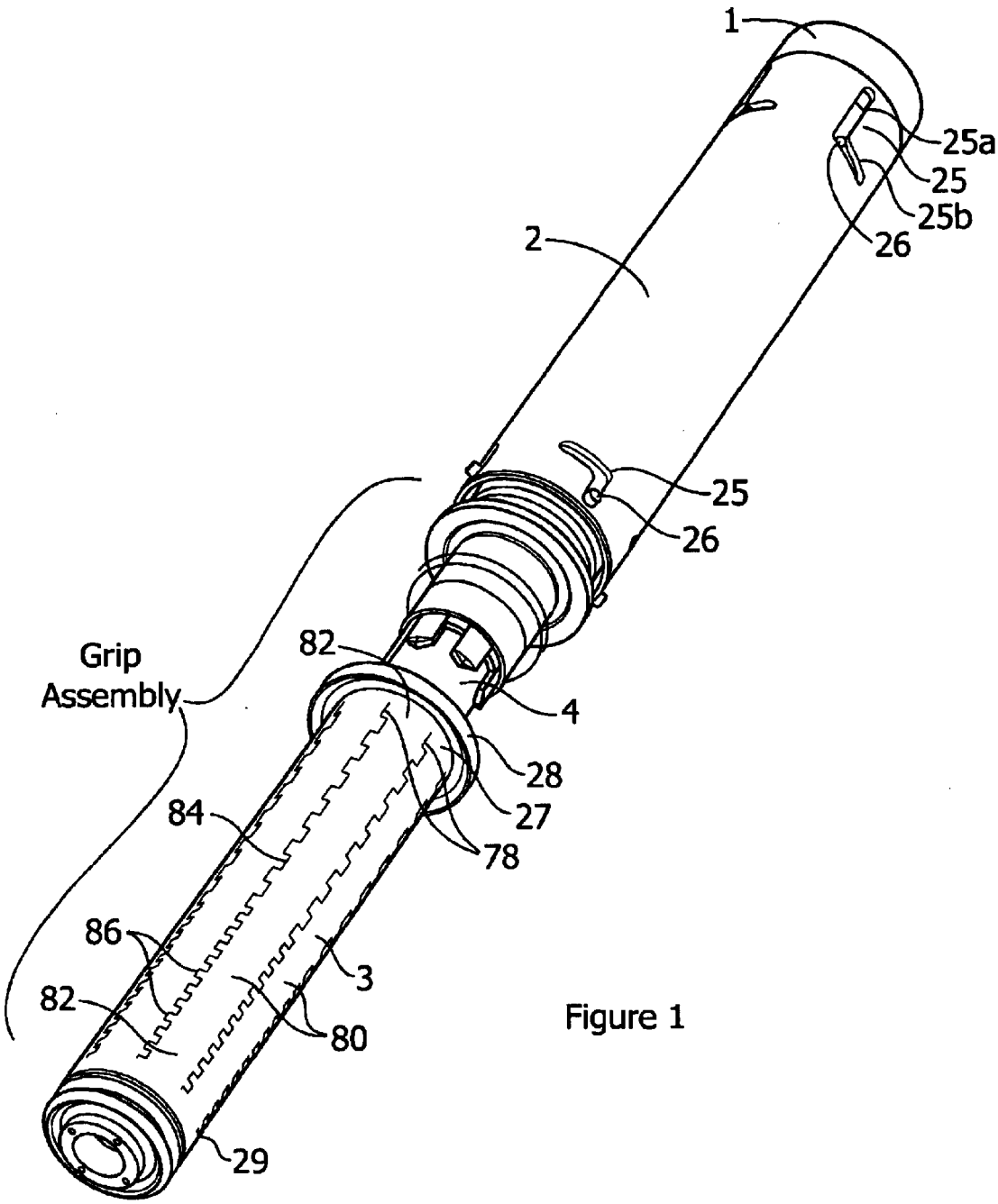
FIG. 1 Isometric view of the assembled top drive make up adapter-tool.

In its preferred embodiment, the tubular internal gripping and handling device of the present invention is configured as a top drive make up adapter tool, which tool connects a crossover sub 1 to an internal gripping assembly through a flexibly coupled tubular drive shaft 2. FIG. 1 is an isometric view of the assembled tool with the grip in its unexpanded state, as it would appear preparatory to insertion into a tubular joint.

Figure 2:
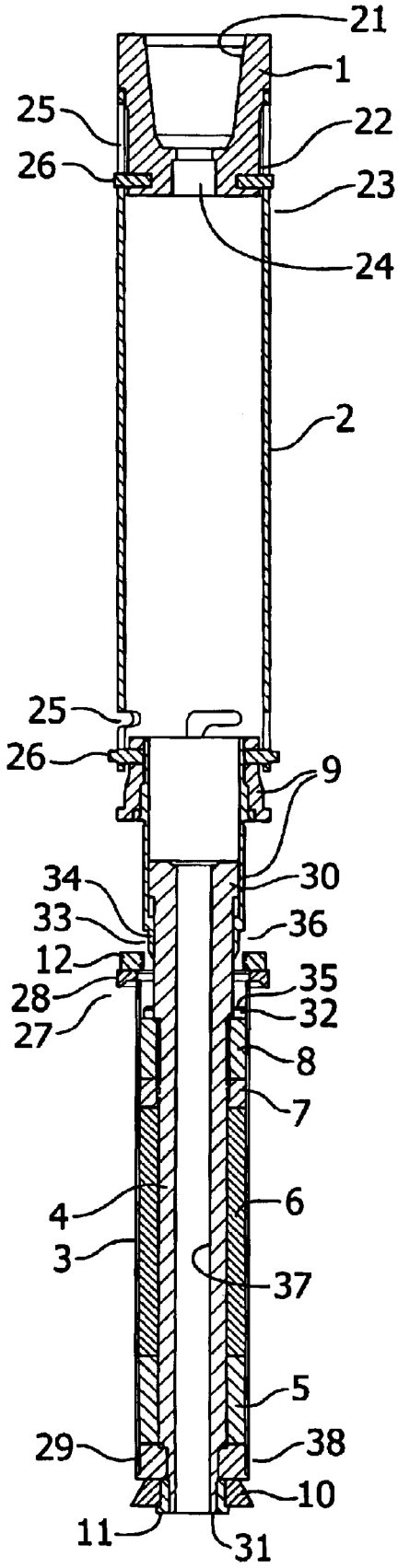
FIG. 2 Longitudinal cross-sectional view through the centre of the top drive make up adapter tool as it appears prior to setting.

The crossover sub 1 is generally cylindrical and made from a suitably strong and rigid material. Referring to FIG. 2, crossover sub 1 has an upper end 10 configured with internal threads 21 suitable for connection to the quill of a top drive and a lower end 22 configured to allow insertion into an upper end 23 of tubular drive shaft 2. In the preferred embodiment it is also provided with a centre bore 24 to allow passage of pumped fluid through the quill as a convenient and desirable means for filling the tubular string.

Referring to FIG. 1, tubular drive shaft 2 is provided with sets of through-wall closed L-shaped slots 25 at each of its upper and lower ends. Slots 25 are distributed equidistantly about the circumference and aligned axially. Tubular drive shaft, 2 is fastened to lower end 22 of crossover sub 1 by means of pins 26 placed through the upper set of slots 25 in tubular drive shaft 2. This provides a flexible connection. The pin positions and outside diameter of the lower end of the crossover sub 1 in the interval of overlap with the tubular drive shaft 2 are so arranged that said flexible connection is free to bend or flex through several degrees in any direction when the pins 26 are in the axial 'leg' 25*a* of the L-shaped slots 25 but prevent such flexibility when the pins 26 are in the lower circumferential leg 25*b* of the L-shaped slots 25. The lower end of the drive shaft 2 is similarly connected by means of pins 26 within L-shaped slots 25 that are inverted and reversed relative to the upper end of the actuator sleeve, 9, comprising the top element of the grip assembly. When the pins 26 are in the axial legs 25*a* of the slots 25, this method of coupling both ends of the drive shaft, 2, to the crossover sub 1 and grip assembly respectively not only provides for lateral translation of the top of the joint with respect to the quill axis but also allows some axial length variation, or stroking, since the pins may ride up and down in their slots, thus enabling the make up adapter tool to provide the function of a floating cushion sub during make up and break out. When the pins 26 are in the circumferential legs 25*b* of the slots 25, this method of coupling allows the tool to be moved and positioned with the lateral flexibility fully disabled, thus providing advantages in handling, particularly valuable in slant rig operations, where the tool would otherwise droop with difficulty then being encountered when attempting to stab into the top of the tubular joint.

Figure 5:
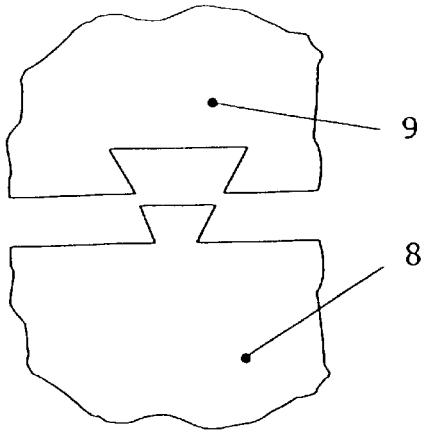
FIG. 5 Schematic showing the general shape of a single 'dovetailed' tooth as they may be employed on the setting nut face with matching grooves in the actuator sleeve.

FIG. 2 is a cross sectional view along the axis of the tool showing the relation of components in the grip assembly portion of the tool. In its preferred embodiment the grip assembly is comprised of several interacting components, those being:

- an expandable generally cylindrical cage 3 with provided with an upper end 27 and a lower end 29. Cage 3 has an outer diameter slightly less than the inside diameter of a tubular work piece 13 except at its upper end 27 where a stop ring 28 with increased diameter over a short distance is provided to create a shoulder sufficient to engage the end of the tubular work piece 13;
- a mandrel 4 is provided having an upper end 30 and a lower end 31. Mandrel 104 has an outside diameter significantly less than the cage 3 internal diameter and placed coaxially inside the cage, 3, with its lower end 31 attached to lower end 29 of cage 3, in a manner enabling transfer of axial load and torque and upper end extended beyond the upper end of the cage 3;
- cylindrical lower spacer sleeve 5 and upper spacer sleeve 7, separated by a generally cylindrical elastomeric setting element 6, or series of elements, to form an element stack, which sleeves and element stack are placed coaxially in the annular space between the cage 3 and mandrel 4, and where the length of the sleeves and element stack is somewhat less than the cage length;
- a largely cylindrical setting nut 8 internally threaded to engage matching threads provided on the mandrel 4 over an interval starting at a position covered by the upper spacer sleeve 7 and having the face of its upper end configured as a dog nut with teeth 32 distributed equidistantly about the circumference, which teeth are preferably shaped as illustrated in FIG. 5;
- an actuator sleeve 9 sliding on the upper interval of the mandrel 4, as illustrated in FIG. 2. Sleeve 9 has notches 33 on its lower end face matching teeth 32 provided on the upper end face of the setting nut 8. Referring to FIG. 2, sleeve 9 has internal splines 34 on its lower end 36 matching external splines 35 provided on upper end 30 of mandrel 4, and having threads on its external surface to accommodate jam nut 12;
- a jam nut 12, internally threaded to fit the actuator sleeve 9 and provided with set screws to lock its position on the actuator sleeve 9 and;
- a swab cup 10, or similar annular seal element such as a packer cup, retained with a nut 11 to the extreme lower end of the mandrel 4.

Referring to FIG. 1, the expandable cage, 3, is generally cylindrical in its body, and in its preferred embodiment is formed from a thin smooth walled vessel of steel or other suitably strong and flexible material by cutting a series of largely square wave slits 78 along a mid length interval of the vessel at several circumferential locations. Although a smooth walled vessel is preferred to avoid surface marking of tubular goods; in some applications cage 3 may be made with a friction enhancing surface to improve its friction coefficient with respect to the tubular good. This forms a series of largely axially aligned strips 80 having their ends 82 attached by the non-slit upper and lower ends of the cylinder but having their edges 84 interlocked by the 'tabs' 86 resulting from the largely square wave cutting pattern. Even though interlocked, there is some space or a gap between the strip edges, the magnitude of which is dependent on the method of manufacturing and tolerancing thereof. It will be evident to one skilled in the art that torsional loading applied along the axis of such a cage will tend to generate twisting distortion with associated shear displacement along the strip edges until any gaps between faces of the tabs are closed. Once these gaps are closed they begin to bear and transfer shear load along the strip length causing the torsional stiffness and strength of the cage 3 to increase dramatically and greatly enhancing it's overall ability to transmit torque. It is therefore desirable to keep the axial gap spacing as small as possible to limit the twist required to engage the tabs. It has been determined that laser cutting offers an efficient means to form slits narrow enough to sufficiently limit the angle of twist before tab contact; however, alternative manufacturing methods may be employed as indeed the cage 3 may built up from individual pieces suitably attached. The square wave amplitude or tab height must further be arranged to ensure sufficient overlap exists to achieve satisfactory shear load transfer when the cage 3 is in its expanded position within the tubular work piece 13. It should also be apparent to one skilled in the art that numerous variations of the slitting geometry may be employed to enhance the fatigue and strength performance of the cage 3, which rely on some form of interlocking to achieve maximum torque transfer capacity while retaining the ability to expand significantly as disclosed herein. Upper end 27 of the cage 3, is provided with an upset diameter forming a stop ring 28 greater than the inside diameter of the tubular work piece 13 end to be gripped. Lower end 29 of cage 3 is typically provided with an internally upset diameter internally splined for attachment to the lower end 31 of mandrel 4.

The generally cylindrical mandrel 4 is formed from a suitably strong and rigid material to enable its function of axial load and torque transfer into the lower end of the cage 3 and in its preferred embodiment is provided with a centre bore 37 to enable fluids to be passed in or out of the tubular work piece 13 if desired. Lower end 31 of mandrel 4 is typically threaded and splined to attach the splined lower end 29 of cage 3 retained by nut 11. The splined engagement being generally indicated by reference numeral 38. In the preferred embodiment the lower threaded interval of the mandrel 4 may also be used to attach the swab cup 10 to provide sealing between the inside of the tubular work piece 13 and the mandrel bore, which method of sealing is well known to the oil field industry. The main body diameter of the mandrel, is selected with respect to the inside diameter of the cage 3 to provide an annular space sufficiently large to accommodate the elastomeric setting element 6. Right hand threads are provided along the mandrel length over an interval where the load nut travel is desired. The upper end of the mandrel 4 is splined where the splines are open downward but have closed or blind upper ends. To facilitate and simplify assembly, the mandrel diameter at each of the intervals described generally increases from the lower to upper end, as needed to accommodate the functions of the threads, splines or controlled diameters. The upper end of the mandrel inside bore is provided with threads suitable for attachment to a hose or similar fluid conduit.

The lower spacer sleeve 5 is a rigid cylinder of sufficient length to extend from the closed end of the cage 3 to a point somewhat above the ends of the cage strips 80 to provide a transition interval over which the strips of cage 3 can expand without being additionally radially loaded by application of expansion pressure by the elastomer. The inside and outside diameters of the lower sleeve are selected to fit inside the annular space between the mandrel 4 and cage 3 while minimizing the elastomer extrusion gaps.

The upper spacer sleeve 7 is similar to the lower spacer sleeve 5 where its length is selected relative to the setting nut 8 and upper end of the cage slots 78 to also provide an interval where cage expansion can occur in the absence of radial expansion pressure.

The setting element 6, or element stack, is largely cylindrical and may be comprised of several separate components including specialized end elements or devices to control extrusion, such as is well known in the well bore packer and bridge plug art, but is generally formed of hydrostatically incompressible and highly deformable elastomeric materials and is dimensioned to largely fill the annular space between the upper spacer sleeve 7 and lower spacer sleeve 5. This annular space and hence element stack must be of sufficient annular thickness and initial length so that the shortening under axial displacement required for expanding the cage 3 and setting, still provides an adequate interval length over which radial displacement and the consequent radial load are sufficient to mobilize the friction grip capacity as required by the application.

The setting nut 8 is a largely cylindrical internally threaded nut with lower end smooth faced to allow sliding contact with the upper end of the upper spacer sleeve 7. The upper face of setting nut 8 is configured with dog nut teeth 32 to enable torque coupling with the actuator sleeve 9. To further facilitate engagement in applications requiring some 'locking', the tooth shape may be dovetailed and oriented so that the narrow portion of the dovetail is attached to the face of the nut as shown in FIG. 5.

The actuator sleeve 9 is largely cylindrical and rigid with internal diameter slightly greater than the upper end of the mandrel 4 on which it slides. The face of its lower end is provided with evenly distributed notches 33 to engage the matching notches in the upper end of the setting nut 8 which notches may be dovetailed as required to match the setting nut 8 geometry as shown in FIG. 5. The inside surface of the lower end of the actuator sleeve 9 is provided with splines 34 to match the splines 35 on the upper end of the mandrel 4. When assembled, the actuator sleeve 9 is able to slide on the mandrel 4 but is constrained in its lower position by the top of the setting nut 8, referred to as setting mode position, and in its upper position by the blind ends of the spline grooves 35 on the mandrel 4 referred to as torque mode position. The various interacting component lengths are arranged so that the actuator has sufficient travel between these two positions to create a range of motion where neither the setting nut 8 nor the upper mandrel splines are engaged, which intermediate position is referred to as neutral because the actuator sleeve 9 is free to rotate about the mandrel 4. The upper end of the actuator sleeve 9 has an external diameter somewhat less than the internal diameter of the drive shaft 2, and has several holes distributed equidistantly around its circumference to accept pins 6 which provide attachment to the drive shaft 2.

Figure 3:
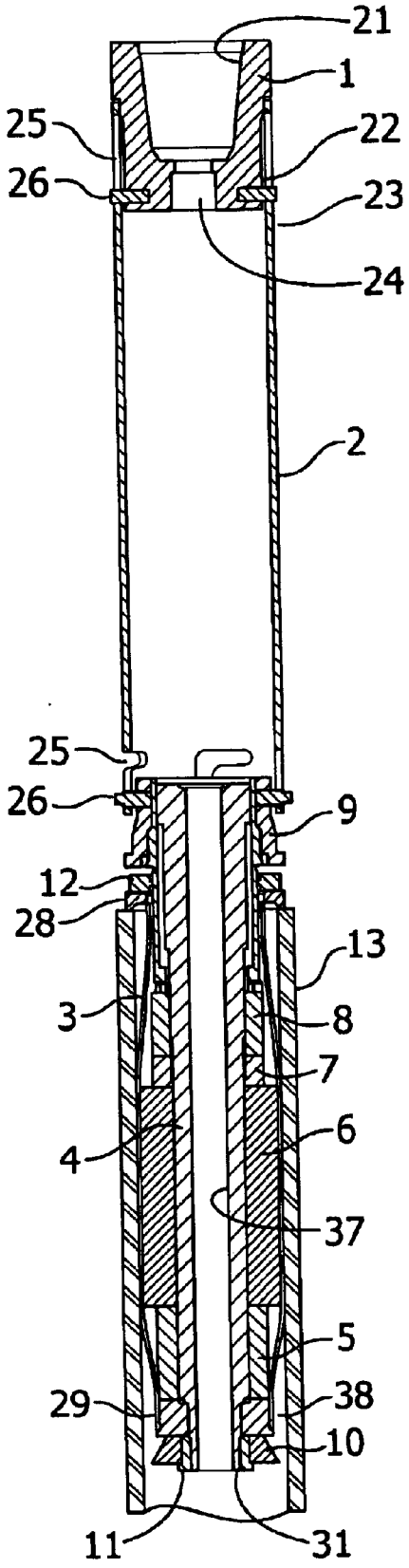
FIG. 3 Longitudinal cross-sectional view of the top drive make up adapter tool with the gripping assembly in setting mode showing exaggerated cage expansion gripping the tubular work piece.

In operation, with the crossover sub 1, of the top drive adapter tool made up to the quill of a top drive rig, the grip assembly is lowered into the top end of a tubular joint until the cage stop ring engages the top end surface of the joint. The top drive is then further lowered or set down on the tool which causes the actuator sleeve 9 to displace downward until its notched lower end 33 engages the teeth 32 on the upper face of setting nut 8. This position is referred to as setting mode. Right hand rotation of the top drive then drives the nut downward against the upper spacer sleeve 7 which acts as an annular piston, compressing the elastomeric element and causing it to expand radially thus forcing the cage 3 outward and into contact with the inside surface of the tubular work piece 13. Continued right hand rotation causes largely hydrostatic compression of the elastomer with consequent development of significant contact stress between the cage 3 and the inner surface of the tubular over the length of the elastomeric setting element 6. Frictional resistance to the compressive axial load is developed in the setting nut threads and end face and is manifest as torque at the top drive. It will be apparent that this torque is reacted through the tool into the tubular joint. Until the cage 3 is expanded, this reaction is provided by incidental friction of the cage strips, the swab cup 10 and contact with the stop ring 28. Once activated the cage expansion 'self reacts' the increasing setting torque, a measurement of which is available to the top drive control system and may be used to limit the amount of setting force applied. As a further means to limit the amount of setting force applied, the position of the jam nut 12 may be adjusted up or down on the actuator sleeve by rotation, and locked with the set screws provided in the jam nut 12. When thus positioned and locked the jam nut will engage the top of the cage and 'jam' during setting with consequent dramatic torque increase and thus limit the downward travel of the actuator sleeve and hence setting nut. When sufficient setting torque has been applied, the tool is considered set. FIG. 3 shows a cross section of the tool in setting mode with the cage, 3, expanded into contact with the tubular work piece 13.

Once set, the top drive is-raised which disengages the lower face of the actuator sleeve 9 from the setting nut 8 and upon being further raised engages the actuator sleeve splines 34 and mandrel splines 35 at the upper extent of the actuator range of travel where the closed ends of the mandrel spline 35 grooves prevent the actuator sleeve 9 from sliding off the top of the mandrel 4. This position is referred to as torque mode and either right or left hand torque may by transferred through the actuator sleeve 9, directly to the mandrel 4.

As is apparent in FIG. 1, the application of right hand torque during setting will move the pins out of the circumferential leg **25*b* of the L-shaped slots 25 so that when the quill is raised to engage torque mode, the pins will tend to slide up the axial legs 25*a*** of the L-shaped slots and re-establish the flexibility of the drive shaft coupling.

If the joint is to be broken out, the top drive is positioned to allow the drive shaft 2 to 'float', i.e. with the pins positioned approximately mid-way in the slots, and reverse torque applied. Once broken out, the joint weight may be supported by the tool and raised out of the connection until gripped by separate pipe handling tools. Once gripped by the pipe handlers, the top drive is set down on the tool, engaging the set mode. Left hand torque is then applied and the setting nut 8 rotated a sufficient number of turns to release the tool. The amount of rotation required to release will in general be equal to the number of turns required for setting.

If the joint is to be made up, its weight may be supported by the tool while being positioned and stabbed into the connection to be made up. Once stabbed, and with the joint weight still largely supported by the tool, the connection may be made up. As for break out, the tool is released by setting down the top drive to engage set mode and applying sufficient left hand rotation to release the tool.

For either make up or break out, it will be evident from FIG. 1, that setting down and applying left hand torque will cause the pins 26 to move into the circumferential legs 25*b* of the L-shaped slots. Upon withdrawal from the tubular work piece 13, the tool will be more or less rigidly coupled to the quill, facilitating stabbing into the top of the next joint of tubular goods to be handled.

Figure 4:
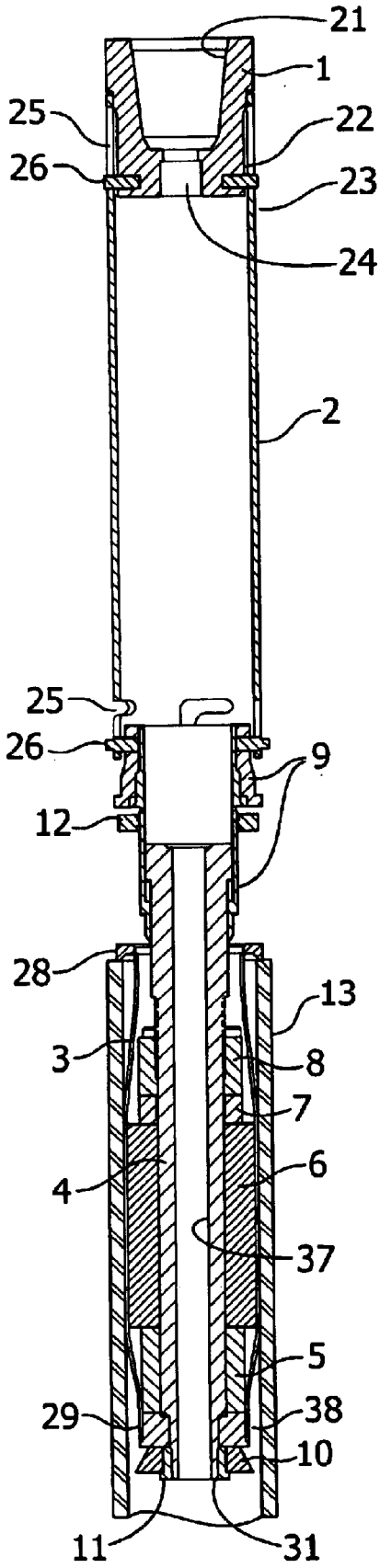
FIG. 4 Longitudinal cross sectional view of the top drive make up adapter tool with gripping assembly in torque mode showing exaggerated cage expansion gripping the tubular work piece.

FIG. 4 shows the tool in torque mode set inside a tubular work piece 13. It will be evident to one skilled in the art that loads (torque or tension) applied to the mandrel 4 with the tool set and in torque mode are reacted in part into the tubular work piece 13 by shear coupling through the annular thickness of the elastomer and cage material compressed between the mandrel 4 and tubular work piece 13. However the greater part of any applied loads are reacted through the lower end of the mandrel 4 into the lower end of the cage 3, and from there, are shed into the tubular work piece 13 over the interval along which it is in contact with the expanded cage 3. The axial or torsional load required to initiate slippage is therefore determined by the area in contact, the effective friction coefficient acting between the two surfaces and the normal stress acting in the interfacial region between the cage 3 and work piece 13. It will be further evident to one skilled in the art that to provide sufficient torque and axial load capacity, these variables may be manipulated in numerous ways including: lengthening the expanded interval of the grip; coating, knurling or otherwise roughening the cage exterior to enhance the effective friction coefficient; increasing the axial stress that may be applied to the elastomer through improved materials and extrusion protection (within the limits imposed by the allowable stress state (e.g., burst capacity) of the tubular work piece, 13), and; reduced friction loss along the setting element 6 by disposing lubricants on the mandrel and cage surfaces contacted by the setting element 6, perhaps in combination with friction reducing coatings such as Teflon®.

It will be apparent to one skilled in the art that as the elastomer is compressed from the top, sliding resistance will tend to cause the hydrostatic stress to decrease from top to bottom over the elastomer length. It has been found in practice that lubrication of the elastomer surfaces can be employed to reduce this effect if required to either improve the 'self starting' response or the relationship between setting torque and axial or torsional grip capacity.

To provide further functionality in applications where it is desired to apply fluid pressure or flow fluids into or out of the tubular work piece 13, as often occurs when running casing which must be filled from the top, in its preferred embodiment the top drive adapter tool is configured with a hose connected between the bottom end of the crossover sub bore and the top of the mandrel bore. The hose length and positioning must be arranged to accommodate the length change between the hose end attachment points occurring during operation as allowed by the axial stroke of the drive shaft slots and the movement of the actuator sleeve, 9. Positioning the hose as a coil inside the drive shaft, 2, provides one means to accommodate the required length change during operation. The hose and connections must also accommodate rotation of the cross over sub 1 with respect to the mandrel 4 during setting and unsetting or if rotating in neutral. A swivel coupling, or other suitable means, may be used to provide this function.

To further enhance the operational and handling characteristics of the tool, springs may be provided between the drive shaft 2, crossover sub 1 and grip assembly. A compression spring may be provided between the drive shaft 2 and actuator sleeve 9 to reduce the tendency for the actuator sleeve 9 to become disengaged from the setting nut, 8, while rotating in setting mode without downward travel of the quill. A tension spring may be provided between the crossover sub 1 and the drive shaft 2 to similarly reduce the tendency of the actuator sleeve spline to disengage from the mandrel 4 while rotating in torque mode to break out a joint, which break out tends to push the joint upward. As the joint moves upward in the absence of quill travel, sliding will tend to occur in the tool either within the slots of the drive shaft 2 or by sliding between the engaged actuator sleeve and mandrel splines. It will be seen that the tension spring biases the pins in the upper end of the drive shaft 2 to slide in favour of the engaged spline. It will be evident to one skilled in the art that various other biasing strategies may be similarly employed such as control of friction coefficient in the pinned flexible couplings relative to the engaged components to simplify operating procedures. Alternatively, details of the engagement mechanisms may be varied to accomplish similar purposes such as lengthening the overlapped splined interval or modifying the tooth and notch profile between the setting nut 8 and actuator sleeve 9 to obtain a more preferential friction angle. One such configuration is shown in FIG. 5.

In the preferred embodiment, expansion of the cage 3 is accomplished by elastomeric material that comprises the setting element 6 making direct contact against the cage, so that under setting stresses, elastomer extrusion into the gaps between cage strip edges is possible. If the combination of applied stress and gap size required for certain applications results in excessive extrusion, the cage gaps may be bridged by provision of individual thin solid strips placed on the inside surface of the cage 3 so as to cover the gaps over the interval where elastomer load occurs. To facilitate assembly, said strips may be fastened to one or the other of the strips forming the gap to be bridged.

Preferred Embodiment Incorporating Additional Integral Hoisting

In its preferred embodiment as a top drive make up adaptor tool, the method of the present invention readily accommodates the axial and torsional loads required to handle, make up and break out single joints of pipe as required to run casing or tubing strings in and out of well bores. However, to support applications where the hoisting loads associated with running such strings may exceed the ability of the internal friction grip of the make up adaptor tool to reliably support the string weight, the tool may be provided with an externally gripping, integral hoisting sub-assembly.

Figure 6:
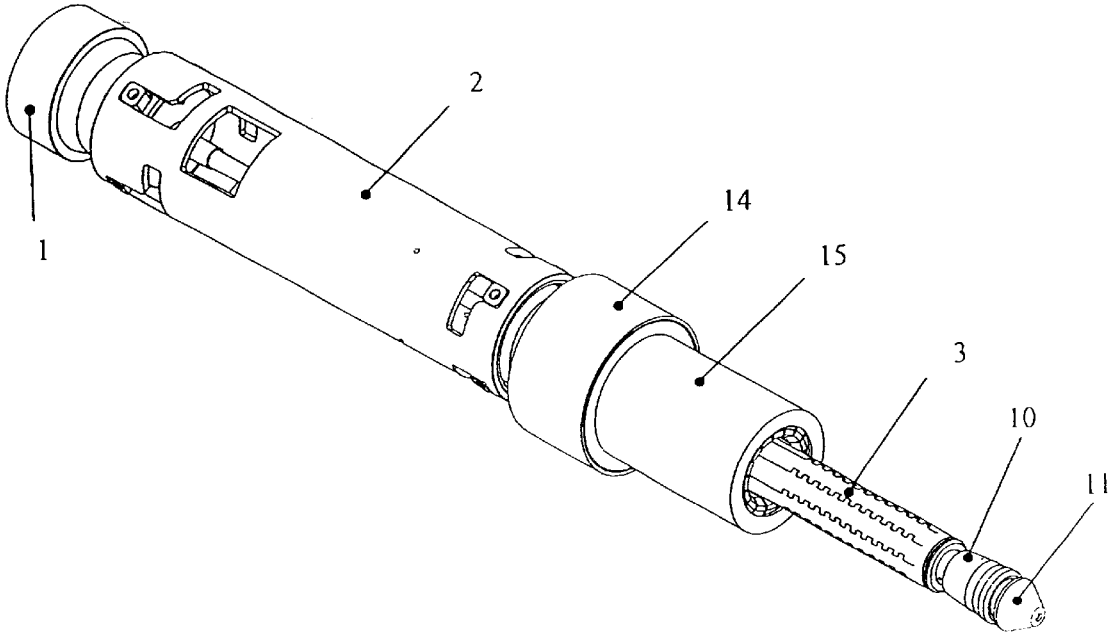
FIG. 6 Isometric view of the assembled top drive make up adaptor tool configured with externally latching, integral hoisting sub-assembly.
Figure 7:
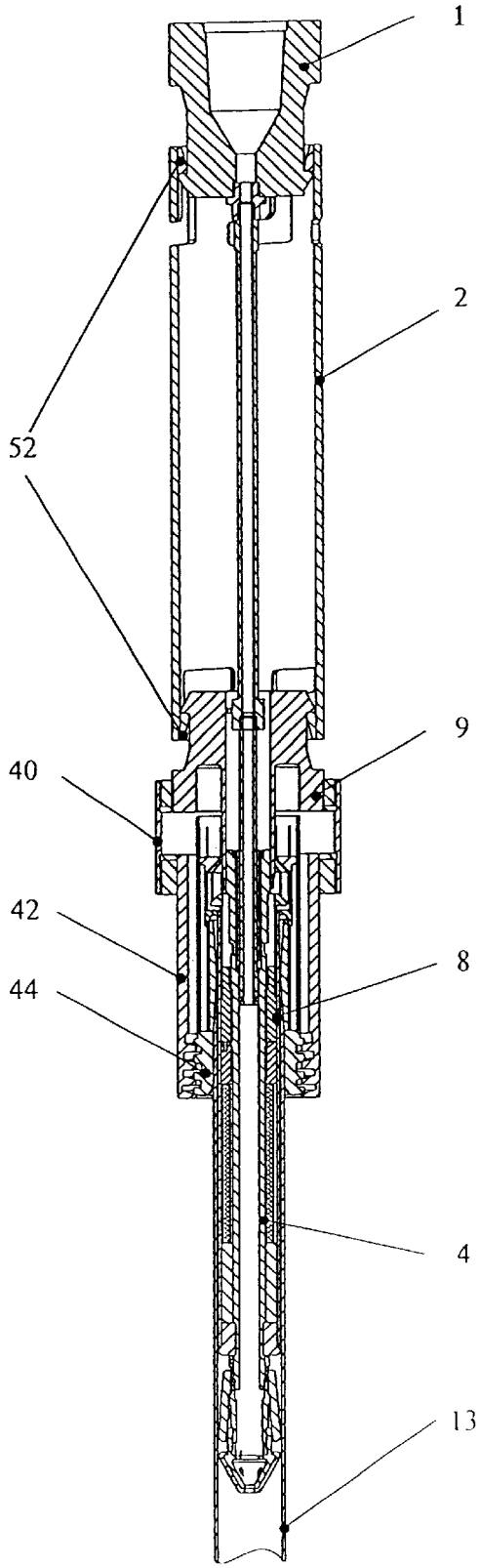
FIG. 7 Longitudinal cross-sectional view along the axis of the top drive make up adapter tool with hoisting sub-assembly showing position of components with tool in hoisting mode engaging the collar on the upper end of a typical tubular work piece.

FIG. 6 shows an isometric view of a tool configured with such a hoisting sub-assembly, showing the general location of the components supporting the hoisting function relative to the cage 3 and drive shaft 2. The components comprising the hoisting sub-assembly may be described with reference to FIG. 7, which shows an entire longitudinal cross section along the tool axis, and FIG. 8, which shows a close up view of the tool centre interval. In these figures the hoisting components are shown in relation to the tubular work piece 13 having a threaded collar 41 forming its upper end as is typical of oil field casing or tubing. The components are shown as they would appear when hoisting.

A largely cylindrical hoist tube 40, is attached at its upper end to the actuator sleeve 9 and at is lower end to the upper end of a largely axisymmetric hoist collar 42, having an internal diameter somewhat greater than the outside diameter of the work piece collar 41 and having a length extending below the lower face of the work piece collar 41. The lower end of the hoist collar, 42, is provided with one or more relatively deep grooves, forming teeth having a shape similar to buttress threads, where the load flank is sloping downward and the stab flank is relatively flat. The latch segments 44 are configured as the lower ends of fingers on the hoist collet 46 having an interior profile closely matching the work piece 13 diameter, below the work piece collar 41 when the collet is in its relaxed state. The exterior surface of the latch segments 44 are profiled to form ribs loosely engaging and generally matching the buttress profile of the grooves provided in the lower end of the hoist collar 42. The root and crest diameters, and other dimensions of the buttress profiled grooves and ribs, are selected to ensure the engagement of the load flanks when the latch segments 44 are positioned against the pipe is sufficient to carry the hoisting load and that the latch segments 44 may displace outward a sufficient distance so that the bore formed by the expanded segments is greater than the outside diameter of the work piece collar 41. The upper end of the latch segments are arranged to align with the lower face of the work piece collar 41 when the actuator sleeve 9 is near the upper extent of its travel in torque mode.

The body of the hoist collet 46 extends upward passed the latch control collet 48 attached to the upper end of the cage 3. The fingers of the latch control collet 48 open upward having ends which form an internal upset conical surface and external upset rounded surface. In its relaxed state, the external diameter defined by the latch control collet 48 fingers, is slightly less than the internal diameter of the relaxed hoist collet 46 body. The setting nut indicator sleeve 50 has a relatively thin cylindrical lower end extending downward and engaging the setting nut 8 at the outside edge of its upper end. The upper end of the setting nut indicator sleeve 50 is provided with an externally upset conical end, dimensioned to engage the internally upset conical end of the latch control collet 48.

To further support the hoisting load capacity of the tool, externally threaded split rings 52 are provided to mate with internal threads on the upper and lower ends of the drive shaft 2. When the slotted and pinned connections between the drive shaft 2 and the crossover sub 1 and actuator sleeve 9 are fully extended, the externally threaded split rings 52 engage shoulders provided in the crossover sub 1 and actuator sleeve 9, which shoulder engagement reacts the hoisting load instead of the pinned connection.

Figure 8:
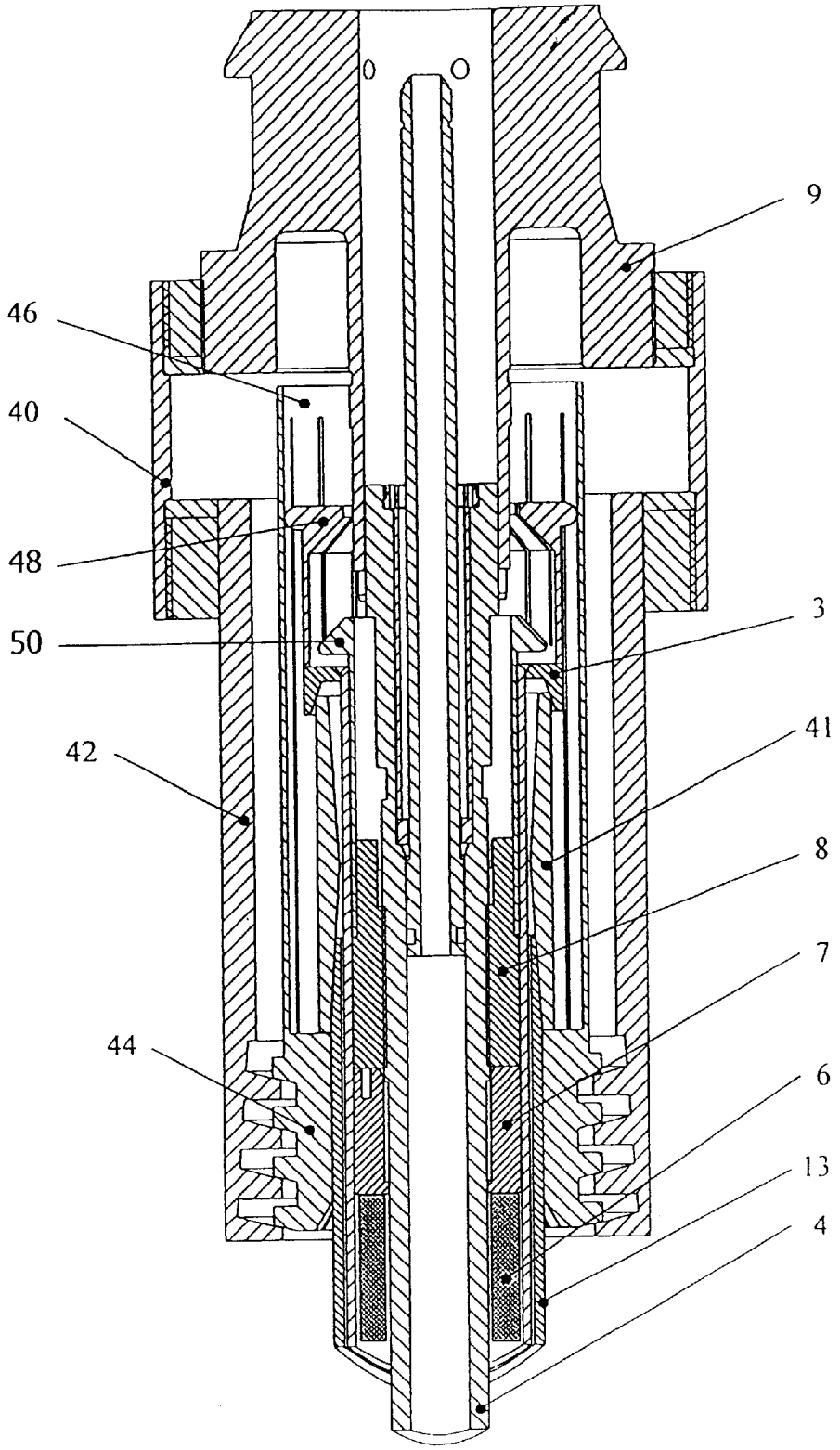
FIG. 8 Longitudinal cross-sectional view of hoisting sub-assembly showing position of components with the tool in hoisting mode, engaging the collar on the upper end of tubular work piece.

In operation the hoisting sub-assembly may be placed in one of two modes depending on the position of the setting nut 8. When the tool is set, the setting nut 8 will be in its lower position compressing the setting element 6. In this position the hoist collet 46 tends to hold the latch segments against the work piece 13 placing the hoisting sub-assembly in hoisting mode as shown in FIG. 8. Application of hoisting load tending to lift the tool, will be transferred through the hoist collar and carry the latch segments upward until their upper ends begin to bear on the lower face of the work piece 13 collar. Upon application of additional hoisting load, engagement of the conical load flank surfaces provided by the buttress shaped hoist collar 42 grooves, and latch segment 44 ribs, tend to create a radial force, in the manner of slips, which radial force ensures positive engagement between the work piece 13 and tool.

Figure 9:
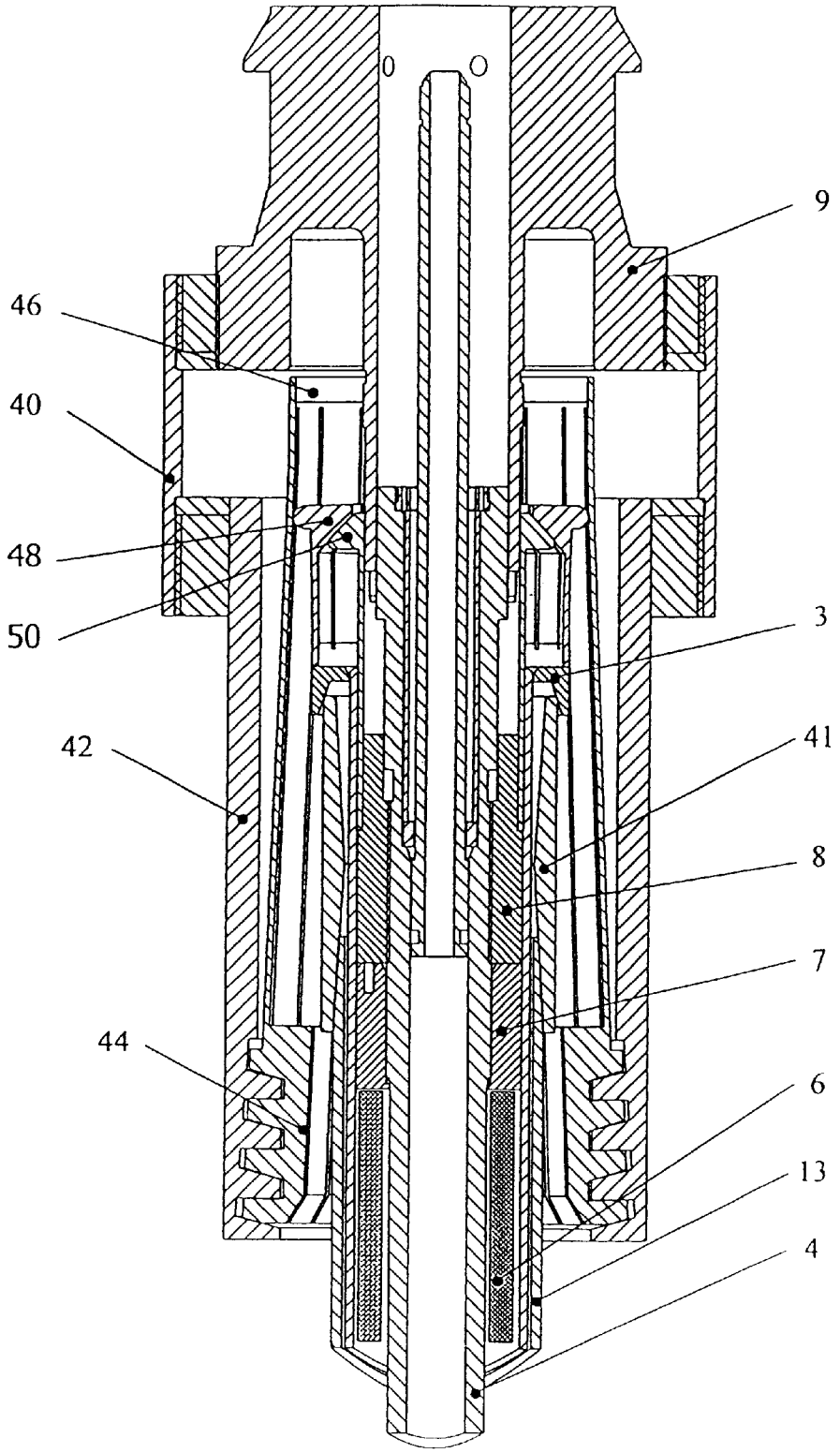
FIG. 9 Longitudinal cross-sectional view of hoisting sub-assembly showing position of components with tool in retract mode.

To disengage the tool from the work piece 13, collar the latch segments 44 must be retracted to place the tool in release mode as shown in FIG. 9. To retract the latch segments, the hoisting load must be removed and the tool un-set by left hand rotation of the setting nut 8, which as described above, raises the setting nut 8 and simultaneously raises the setting nut indicator sleeve 50. Continued left hand rotation brings the upper cone of the setting indicator sleeve into contact with the mating internal conical surface on the inside of the latch control collet 48, forcing the fingers outward and into contact with the interior of the hoisting collet 46 body, expanding the hoisting collet 46 and retracting the latch segments 44 carried on the ends of the hoisting collet 46 fingers, thus enabling the tool to be disengaged from the work piece 13.

Preferred Embodiment Incorporating Additional Axial Load and Fatigue Capacity

As discussed above, advances in drilling rig technology have resulted in increased use of top drive rigs. Top drives are primarily used to apply drilling loads to drill pipe, however they also allow application of handling, make up and break out loads required for running tubulars, referred to as casing and tubing, typically used to case or complete the well. To run casing or tubing requires a method of coupling the quill to the tubular capable of transmitting full make up or break out torque, and at least some axial load, without risking damage to the threaded connections of these tubulars which are less robust than those used to connect joints of drill pipe.

The embodiment of the present invention described to this point, specifically address this need for a tool to support running tubing or casing. However the emerging use of top drives to perform drilling using casing, referred to in the industry as Casing Drilling™, has resulted in the further need for a method to grip casing to perform drilling operations. The preferred embodiment described above, while suited to the needs of make up and break out of casing and tubing for running operations, does not provide the axial load and fatigue capacity required for drilling with casing.

The embodiment which will now be described, with reference to FIGS. 10 through 16, was therefore conceived specifically as a means to couple the top drive quill to casing with a device having sufficient axial and torsional fatigue capacity to support drilling with the casing while preserving the advantages of a friction grip provided by the earlier casing running tool.

To meet these objectives, the method of the present invention makes use of a device having an upper end provided with a cross-over sub to attach to the quill of a top drive and having a lower end provided with a grip assembly, which may be inserted into the top end of a tubular work piece and expanded to engage or grip the inside surface of the tubular work piece. The grip method and contacting element preferably frictionally engage the inside wall of the tubular with symmetric radial loading, virtually eliminating the risk of marking or distorting the pipe or connection. The method of expansion employed in the grip assembly further provides means whereby the application of axial load tends to increase the gripping force applied by the device to the work piece, better enabling hoisting loads to be reliably transferred from the quill into the tubular joint. It will be understood that such attachment to the top drive quill may be direct or indirect to other intermediate components of the drill string such as a 'thread saver sub' essentially forming an extension of the quill.

The cross over sub is coupled to the grip assembly by means of a sliding, splined and sealing connection, providing the function of a 'cushion sub' to facilitate management of load during make-up, transmission of axial and torque loads and containment of fluids. The grip assembly is further arranged to permit the grip to be activated, or set, by application of right hand torque and deactivated or released by application of left hand torque when a first operating mode is engaged. In a second operating mode, either left or right hand torque is transferred directly through the grip without changing the grip force. The first or setting mode is engaged by application of slight downward axial movement, or setting the quill down. The second or direct torque mode is engaged by lifting the quill up once the grip is set, i.e., application of upward movement until slight tensile resistance occurs. These simple, fast and direct means of gripping and releasing provide substantial operational improvements over the existing methods.

Summary of Preferred Embodiment Incorporating Additional Axial Load and Fatigue Capacity An additional purpose of the present invention is to provide a method employing an internal gripping device for handling tubular work pieces in general and particularly suited for connecting between a top drive quill and upper joint of casing in a string used for Casing Drilling™, having as its gripping mechanism a sub-assembly comprised of:

1. a generally cylindrical expandable cage with upper and lower ends,
2. a structural member in the form of a mandrel is provided. The mandrel has upper and lower ends placed coaxially inside the cage where the lower ends of the mandrel and cage are attached in a manner allowing torque transfer and some relative axial movement, and where the external diameter of the cage is somewhat less than the internal diameter of the tubular work piece to be gripped, allowing the cage to be placed inside the tubular work piece,
3. a significant annular space between the inside surface of the cage and the outside surface of the mandrel,
4. a pressure member disposed in the lower interval of the annular space between the mandrel and cage as a spring expansion element, and
5. means to activate the spring expansion element to cause the cage to expand and frictionally engage the inside surface of the tubular work piece with sufficient radial force to enable transfer of significant torque and axial load from the upper end of the mandrel through the cage to the tubular
6. further means to increase the radial force applied by the spring expansion element, beyond that provided by the activation means, upon application of sufficient axial load as may be required to support some portion of the-string weight while conducting running or drilling operations.

Said cylindrical cage of the gripping mechanism having a lower and upper end:

is preferably comprised of a plurality of strips aligned largely axially along the body of the cage and attached to cylindrical sleeves at each end of the cage, where the edges of adjacent strips are preferably profiled to provide interlocking tabs or fingers, and which fingers permit cage expansion or radial displacement of the strips but tend to prevent cage twist or shear displacement between strips under torsion loading.

Said means to provide cage expansion is preferably provided by:

a generally cylindrical helical spring expansion assembly disposed in the central interval of the annular space between the mandrel and cage, which helical spring expansion assembly is formed by a plurality of structural, coaxial, helically parallel coils having co-terminal upper and lower ends and side edges, and by upper and lower spring end sleeves structurally engaging the upper and lower co-terminal ends of the coils, means to axially compress the cylindrical helical spring assembly with sufficient force to cause the cage to expand and frictionally engage the tubular work piece enabling transfer of torque and axial load from the upper end of the mandrel through the cage to the tubular, which structural engagement between the coil ends and sleeves preferably using a pivoting connection formed by providing said coil ends with a curved profile to mate with sockets placed in the upper and lower spring end sleeves where the axis of rotation for each pivoting connection is largely radially aligned to thus facilitate rotation as the helix angle increases under deformation imposed by axial compression causing expansion of the cylindrical helical spring assembly, helix angle of the helically parallel coils chosen so that under compression the spring assembly expands significantly and preferably chosen to be slightly less than 45° with respect to the pipe axis in their expanded configuration, where contact between side edges of helically parallel coils is preferably allowed, but if not allowed a means is provided to react the torque required to prevent edge contact, and which means to react torque to prevent edge contact is preferably obtained largely by providing the cylindrical spring assembly in two co-axial layers having their helixes wound in opposite directions and sleeve elements at their ends connected.

Said means to increase the radial force applied by the expansion element upon application of axial load provided by reacting the lower spring end sleeve into the mandrel and the upper spring end sleeve into the upper end of the cage. Thus configured, lifting load, applied to the upper end of the mandrel, is reacted into the lower end of the cylindrical spring assembly and thence partially reacted by frictional contact through the cage wall into the tubular work piece and partially as tension applied to the top of the cage and resisted by frictional contact between the cage and work piece.

An additional purpose of the present invention is to provide a tubular gripping and handling device having its cross-over sub joined to said gripping sub-assembly by an appropriately splined and dogged connection allowing sufficient free sliding axial movement to facilitate control of axial load during make up required to perform what is known as a 'floating make up', i.e., make up under conditions where at most the weight of the single joint being made up is allowed to be born by the threaded connection undergoing make up.

A further purpose of the present invention is to provide a means to flow fluid and apply pressure through the casing drive tool and into the tubular work piece being gripped. This purpose is realized by providing a flow path through the crossover sub and tool mandrel and is preferably augmented by provision of an internal annular seal, such as a packer or swab cup, attached to the lower end of the mandrel preventing leakage in the annulus between the mandrel and inside surface of the tubular work piece.

Figure 10:
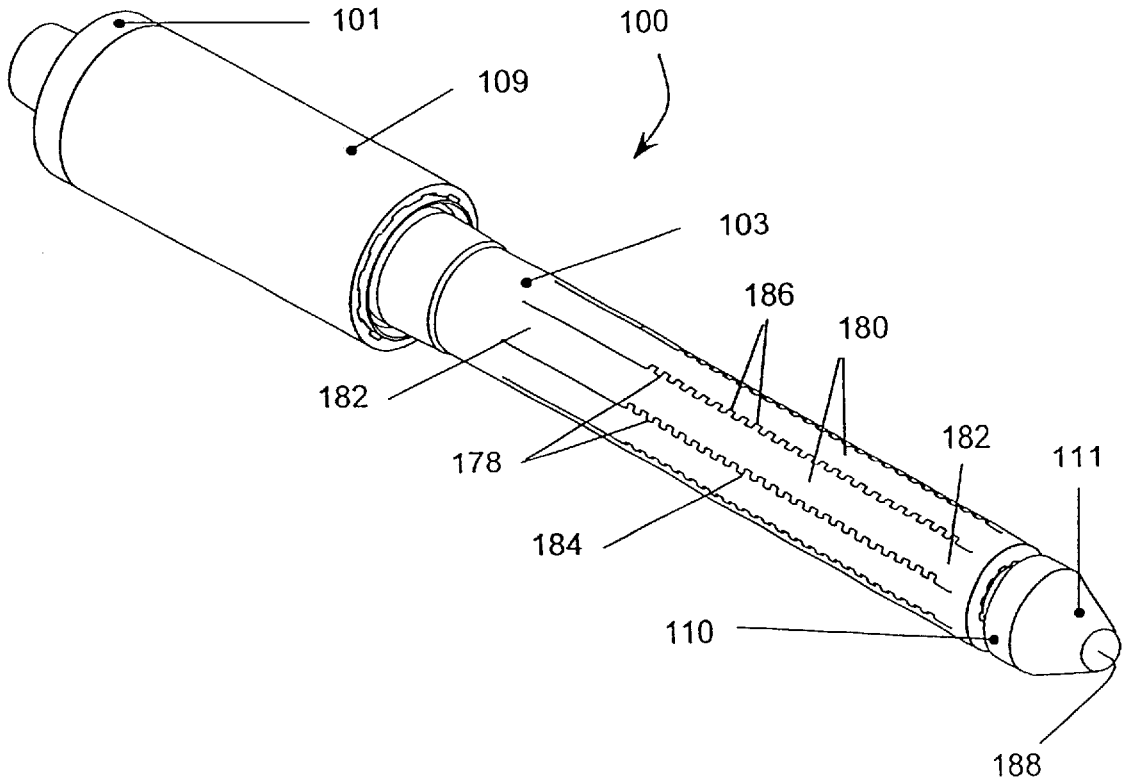
FIG. 10 Isometric view of the assembled casing drive tool.
Figure 11:
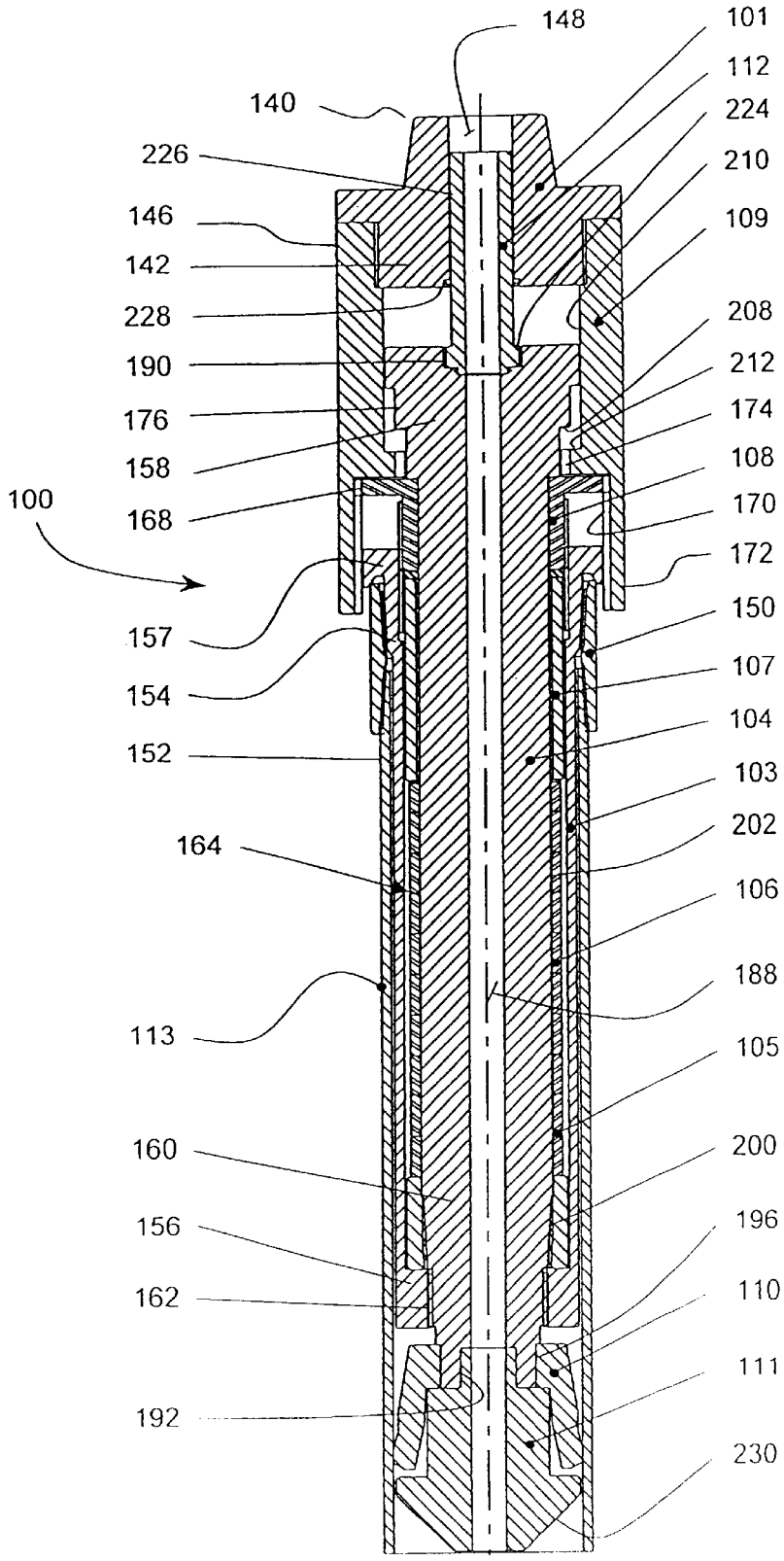
FIG. 11 Longitudinal cross-sectional view through the centre of the casing drive tool as it appears stabbed into the tubular work piece prior to setting.

Description of Preferred Embodiment Incorporating Additional Axial Load and Fatigue Capacity In the preferred embodiment of the present invention incorporating additional axial load and fatigue capacity, the tubular internal gripping and handling device of the present invention, generally referred to as gripping assembly 100, is configured as a casing drive tool. Referring to FIG. 10, gripping assembly 100 connects to a crossover sub 101. Referring to FIG. 11, crossover sub 101, is generally axisymmetric and made from a suitably strong and rigid material. Crossover sub 101 has an upper end 140 configured with threads suitable for connection to the quill of a top drive rig and a lower end 142 configured with threads to engage an upper end 146 of an actuator sleeve of gripping assembly 100. In the preferred embodiment it is also provided with a centre bore 148 to allow passage of fluid pumped through the quill to facilitate various drilling and running operations such as mud circulation.

FIG. 11 is a cross sectional view of the casing drive tool showing the relation of components in the gripping assembly 100 as they would appear stabbed into a tubular work piece 113. Tubular work piece 113 is shown as the top interval of a joint of casing having a collar 150 at its upper end 152. In its preferred embodiment grip assembly 100 is comprised of several interacting components, those being:

an expandable generally cylindrical cage 103 is provided having an upper end 154 and a lower end 156. Cage 103 has an outer diameter slightly less than the inside diameter of tubular work piece 113, except at its upper end 154 where a stop ring 157 with increased diameter over a short distance is provided to create a shoulder sufficient to engage collar 150 at upper end 152 of tubular work piece 113;

a mandrel 104 is provided having an upper end 158 and a lower end 160. Mandrel 104 has an outside diameter significantly less than an internal diameter of cage 103 and is placed co-axially inside cage 103. Upper end 158 of mandrel 104 extends beyond upper end 154 of cage 103. Lower end 160 of mandrel 104 is splined to lower end 156 of the cage 103. This splined interval, indicated by reference numeral 162, enables torque transfer and allows some relative axial movement tending to prevent transfer of axial lifting load from mandrel 104 to lower end 156 of cage 103 and;

there is also provided a cylindrical lower spring end sleeve 105, and an upper spring end sleeve 107, separated by a plurality of coaxial closely spaced helical coils forming a generally cylindrical helical spring element 106. Helical spring element 106 together with the spring end sleeves 105 and 107 form a helical spring expansion assembly, generally indicated by reference numeral 164. Helical spring expansion assembly 164 is placed co-axially in the annular space between cage 103 and mandrel 104. The length of helical spring expansion assembly 164 is somewhat less than the length of cage 103. Lower spring end sleeve 105 is attached to lower end 160 of mandrel 104 directly above splined interval 162 traversed by mating lower end 156 of cage 103;

a largely cylindrical setting nut 108 is provided which is externally threaded to engage matching threads provided in upper end 154 of cage 103. Setting nut 108 has an external spline over a portion of its upper interval, this splined interval being indicated by reference numeral 168;

an actuator sleeve 109 is provided which slides on upper end 158 of mandrel 104. Actuator sleeve 109 has an internal splined interval 170 on its lower cylindrical end 172 that mates with external splined interval 168 on the upper end of setting nut 108. Actuator sleeve 109 also has internal splines 174 matching external splines 176 provided on upper end 158 of mandrel 104, and;

a packer cup 110, or similar annular seal element, is fastened with a nut 111, to the extreme lower end 160 of mandrel 104. Packer cup 110 and nut 111 also constrain the lower travel limit of cage 103, which engages splined interval 162 of mandrel 104.

Referring to FIG. 10, the expandable cage 103 is generally cylindrical and is, preferably, formed from a generally smooth walled vessel of steel or other suitably strong and flexible material. Cage 103 has a series of largely square wave slits 178 along the cylindrical interval of the vessel body at several circumferential locations, thus forming a series of largely axially aligned strips 180. Strips 180 have their ends 182 attached by the non-slit upper and lower ends of the cylinder and have their edges 184 interlocked by the 'tabs' 186 resulting from the largely square wave cutting pattern. Even though interlocked, there is some space or a gap between the strip edges, the magnitude of which is dependent on the method of manufacturing and tolerances thereof. It will be evident to one skilled in the art that torsional loading applied along the axis of such a cage will tend to generate twisting distortion with associated shear displacement along the strip edges until any gaps between faces of the tabs are closed. Once these gaps are closed they begin to bear and transfer shear load along the strip length causing the torsional stiffness and strength of the cage 103 to increase dramatically and greatly enhancing it's overall ability to transmit torque. It is therefore desirable to keep the axial gap spacing as small as possible to limit the twist required to engage the tabs. It has been determined that laser cutting offers an efficient means to form slits narrow enough to sufficiently limit the angle of twist before tab contact; however, alternative manufacturing methods may be employed as indeed the cage 103 may built up from individual pieces suitably attached. The square wave amplitude or tab height must further be arranged to ensure sufficient overlap exists to achieve satisfactory shear load transfer when the cage 103 is in its expanded position within the tubular work piece. It should also be apparent to one skilled in the art that numerous variations of the slitting geometry may be employed to enhance the fatigue and strength performance of the cage 103 that rely on some form of interlocking to achieve maximum torque transfer capacity while retaining the ability to expand significantly as disclosed herein. The non-slit upper end 154 of the cage 103 is provided with a stop ring 157 having an upset diameter greater than the inside diameter of the upper end 152 tubular work piece end 113 to be gripped and internal threads mating with the external threads of the setting nut 108. The lower end of the cage 103 is typically provided with an internally upset diameter internally splined over interval 162 for attachment to the lower end of the mandrel 104.

Figure 12:
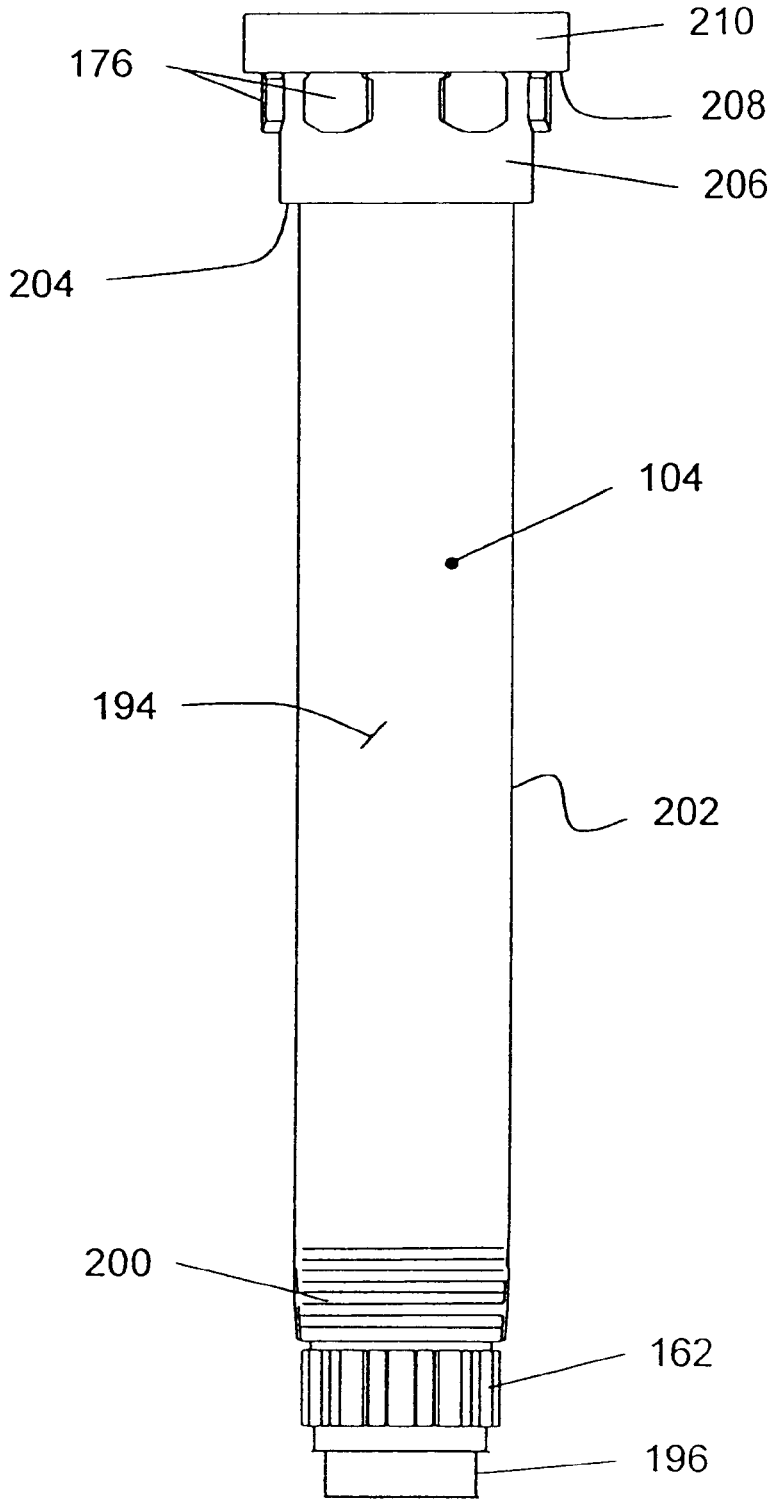
FIG. 12 View of mandrel showing exterior profiled intervals.

Referring to FIG. 11, the generally cylindrical mandrel 104 is formed from a suitably strong and rigid material to enable its function of axial load and torque transfer. In its preferred embodiment, it is provided with a, centre bore 188 to enable fluids to be passed in or out of tubular work piece 113, if desired. An upper end 190 of bore 188 is enlarged and threaded to attach a flow tube, 112. A lower end 192 is similarly enlarged and threaded to attach the nut 111. An outer surface 194 of the mandrel is shaped as shown in FIG. 12 to accommodate connection to and interaction with various sub-components of the system and has the following intervals described in order from its lower to upper end.

Outer surface 194 on lower end 160 of the mandrel 104 is smooth to form a packer seal interval 196. The packer cup, 110, provides annular sealing between the inside of the tubular work piece and the mandrel bore, which method of sealing is well known to the oil field industry.

Directly above the packer seal interval 196 is lower splined interval 162 that engages the internally splined lower end 156 of the cage 103, which splined interval is of sufficient length to allow cage 103 to slide axially.

Above lower splined interval 162 is an upper threaded interval 200 that engages the internally threaded lower spring end sleeve 105, which threads are tapered in the preferred embodiment to maximize the axial load transfer efficiency of the connection.

Extending upward from the upper threaded interval 200 is the central body interval 202 having a diameter slightly less than the internal diameter of the unloaded helical spring expansion assembly 164.

Central body interval 202 extends upward from upper threaded interval 200 and ends abruptly at a shoulder 204 forming the lower limit of a stop shoulder upset interval 206 having a diameter slightly less than the crest diameter of the actuator sleeve 109 internal splines 174 and length somewhat greater than the actuator sleeve 109 mid-section splined interval 170. Shoulder 204 acts as a stop, limiting the range of relative upward travel allowed to setting nut 108, with respect to the mandrel 104.

Directly above stop shoulder upset interval 206 is the upper splined interval 176 which splines are open downward and configured to facilitate engagement with internal splines 174 of actuator sleeve 109.

A shoulder 208 forming the lower limit of hoisting shoulder upset interval 210, closes the upper end of upper splined interval 176. Shoulder 208 engages a matching internal shoulder 212 in actuator sleeve 109, enabling transfer of hoisting loads from actuator sleeve 109 to mandrel 104.

It will thus be apparent that to facilitate and simplify assembly, the mandrel diameter at each of the intervals described generally increases from its lower to upper end, as needed to accommodate the functions of the threads, splines, shoulders or controlled diameters.

Figure 13:
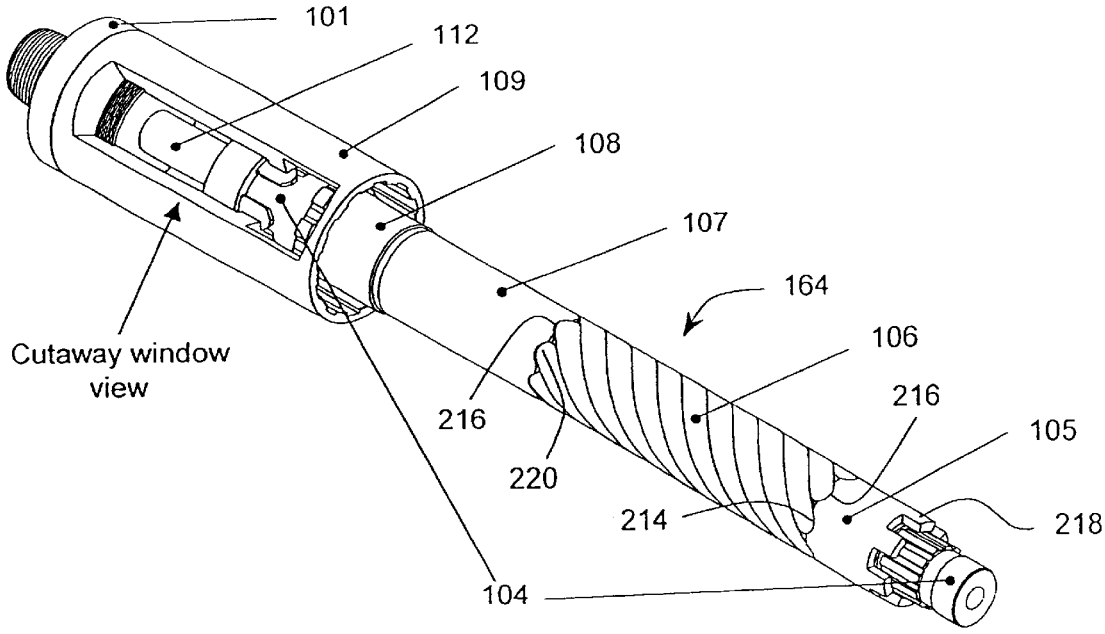
FIG. 13 Isometric view of the casing drive tool with cage removed showing helical spring expansion assembly.

The lower spring end sleeve, 105, is a rigid cylinder, internally threaded to engage the mandrel 105 as described above. It is of sufficient length to extend from the cylindrical end of the cage 103 to a point somewhat above the ends of cage strips 180. This provides a transition interval over which the strips of cage 103 can expand without being additionally radially loaded by application of expansion pressure by the helical spring element 106. The outside diameter of the lower spring end sleeve 105 is selected to fit just inside the cage 103. Referring to FIG. 13, its lower end 214 is contoured or scalloped to form sockets 216 mating with the rounded ends of the helical coils constituting the helical spring element 106. Its lower end 218 is configured as a dog nut to mate with dogs provided in lower end 156 of internally upset splined interval 162 of cage 103. The dog teeth are configured to be engaged over the range of motion allowed to the cage 103 with respect to the mandrel 104. This prevents lower spring end sleeve 105 from rotating on the mandrel 104, enabling transfer of torque from the mandrel 104 into the helical spring assembly 164.

The upper spring end sleeve 107 is similar to the lower spring end sleeve 105, having its lower end 220 contoured or scalloped. Its length is selected relative to the setting not 108 and upper end of cage slits 178 to also provide an interval where cage expansion can occur in the absence of radial expansion pressure. However its internal bore is smooth to facilitate sliding relative to the mandrel.

Referring to FIGS. 11 and 13, the helical spring element 106 is largely cylindrical and comprised of a plurality of coaxial closely spaced coils formed with a helix angle slightly less than 45° with respect to the cylinder axis. In its preferred embodiment, the coils of the helical spring element 106, have a rectangular cross-section with smooth edges nearly touching when unloaded. When assembled between the upper spring end sleeve 107 and lower spring end sleeve 105 to form a helical spring expansion assembly 164, the coil ends and sockets 216 form pivoting connections as shown in FIG. 13. In operation, axial compression applied to the helical spring expansion assembly initially brings the coil edges into contact. Further application of load tends to cause the entire helical spring element to expand radially. Confined by the cage 103, which is in turn confined by the tubular work piece 113, the application of sufficient axial load results in a radial or pressure load being transferred through cage 103 and reacted by work piece 113. The presence of such radial load at both the inner and outer surfaces of cage 103 enables frictional transfer of axial and radial loads from upper end 158 of mandrel 104 to work piece 113 both through helical spring element 106 and through cage ends 154 and 156. Spring element 106 must be of sufficient length so that the radially loaded interval provides an adequate area over which to mobilize the friction grip capacity required by the application. The thickness of spring element 106, and mating lower and upper spring end sleeves, 106 and 107, are selected to ensure sufficient contact area exists across the pivoting connections to transfer the required axial load when spring 106 is expanded.

The setting nut 108, is a largely cylindrical externally threaded nut with internal diameter slightly greater than the mandrel 104 main body interval 202 and lower end smooth faced to allow sliding contact with the upper end of the upper spring end sleeve 107, which sliding contact may be enhanced by the addition of a thrust washer or other means generally known in the industry to manage wear and promote consistent frictional resistance. The upper end of the setting nut 108 is upset and carries external spline 168 engaging internal spline 170 on lower end 172 of actuator sleeve 109, which splined connection enables torque coupling while allowing relative axial sliding movement.

The actuator sleeve 109 is largely axisymmetric and rigid, with a generally uniform diameter external surface. Its internal surface is profiled to mate with three components as follows. Its lower end 172 forms an internally splined cylindrical sleeve 170 to engage the matching exterior splines 168 in the upper end of the setting nut 108, which splined connection is loose fitting providing a significant amount of rotational back-lash, and sufficiently long to accommodate the full travel of the setting nut 108. Directly above the splined sleeve interval 170 is a relatively short internally upset mid-section splined interval 174 engaging the mandrel 104 upper splined interval 176. Above the mid-section splined interval 174 the bore increases to accommodate hoisting shoulder upset interval 210 of mandrel 104, with shoulder 212 of actuator sleeve 109 engaging shoulder 208 of mandrel 104. The bore extends to the upper end of the actuator sleeve 109, where it is provided with threads to connect with the crossover sub 101.

When assembled, the actuator sleeve 109 is able to slide on the mandrel 104, and is constrained in its upper position by hoisting shoulder 208 on mandrel 104, enabling transfer of hoisting load from the mandrel 104 into the actuator sleeve 109. The range of motion from this upper position downward to the point where the actuator sleeve and mandrel splines disengage is referred to as torque mode, and is illustrated in FIGS. 15 and 16. The interval between the position where actuator sleeve 109 is lowered a sufficient distance to first disengage the mandrel splines 176 and its lowest position constrained by contact with the top of setting nut 108, is referred to as setting mode position and is illustrated in FIGS. 11 and 14. The various interacting component lengths are preferably arranged so that the actuator has sufficient travel in both torque and setting modes to provide the function of a 'floating cushion', where no significant axial load may be transferred between the tool and work piece.

In its preferred embodiment a flow tube 112 is provided between the interior bores 188 and 148, respectively, of mandrel, 104, and crossover sub, 101. A lower end 224 of flow tube, 112, is sealingly threaded to upper end 190 of the mandrel bore 188. An upper end 226 of flow tube 112 extends telescopically into the lower end of the crossover sub bore 148 through an annular seal 228 carried in the lower end of the crossover sub bore 148. This configuration readily accommodates the required range of sliding between the crossover sub 101 and mandrel 104 while minimizing the fluid end load that would otherwise occur if sealing were provided between the mandrel 104 and actuator sleeve 109.

In its preferred embodiment the nut 111 is provided with a lower conical end 230 to facilitate stabbing into the tubular work piece 113. Where upper end 152 of tubular work piece 113 carries an interior box thread, as is typical for casing and tubing joints, the conical end surface is preferably coated with an elastomer or similar relatively soft material to mitigate the potential for damage to the threads.

In operation, with crossover sub 101 of the casing drive tool made up to the quill of a top drive rig, the grip assembly is lowered into the top end of a tubular joint until the cage stop ring 157 engages the top end surface, illustrated as collar 150, of the joint. The top drive is then further lowered or set down on the tool which causes the actuator sleeve 109 to displace downward until it disengages from spline 176 on mandrel 104 and simultaneously causes cage 103 to slide up lower splined interval 162 of mandrel 104 until stopped by contact between lower spring end sleeve, 105 and lower end 156 of cage 103. This position is referred to as setting mode, as illustrated in FIG. 11. Right hand rotation of the top drive then drives nut 108 downward against upper spring end sleeve 107, which acts as an annular piston, compressing helical spring 106 causing it to expand radially, thus forcing cage 103 outward and into contact with the inside surface of the tubular work piece, as illustrated in FIG. 14. Continued right hand rotation causes largely biaxial compression of the helical spring element, 106, with consequent development of significant contact stress between the cage 103 and the inner surface of the tubular over the length of the spring element. Frictional resistance to the compressive axial load is developed in the setting nut threads and end face and is manifest as torque at the top drive. It will be apparent that this torque is reacted through the tool into the tubular joint. Until the cage 103, is expanded, this reaction is provided by incidental friction of the cage strips 180, the packer cup 110 and contact with the stop ring 157. Once activated the cage expansion 'self reacts' the increasing setting torque, a measurement of which is available to the top drive control system and may be used to limit the amount of setting force applied. When sufficient setting torque has been applied, the tool is considered set. FIG. 14 shows a cross section of the tool in setting mode with the cage 103 expanded into contact with the tubular work piece.

Once set, the top drive may be raised to engage the torque mode position, where the upward movement causes the actuator sleeve 109 to slide up relative to the mandrel and engage the splines 174 and 176, respectively, between the actuator sleeve 109 and mandrel 104. At the upper extent of the actuator range of travel the actuator sleeve shoulder 212 engages the mandrel shoulder 208 to prevent the actuator sleeve 109 from sliding off the top of the mandrel 104 and enable transfer of hoisting loads. To facilitate engagement of this spline, the mating spline tooth ends on both the mandrel 104 and actuator sleeve 109 are appropriately tapered. Engagement is further facilitated by the relatively loose fitting spline engagement between the actuator sleeve 109, and setting nut 108 allowing some relatively free rotation. Thus in torque mode either right or left hand torque may by transferred through the actuator sleeve 109 directly to the mandrel 104. FIG. 15 shows the tool in torque mode, set inside a tubular work piece as it might appear prior to making up or breaking out a joint.

Thus set, if the joint is to be broken out, the top drive is positioned to place the actuator sleeve 109 at or near the upper limit of the 'float' provided in torque mode, and reverse torque applied. Once broken out, the joint weight may be supported by the tool and raised out of the connection until gripped by separate pipe handling tools. Once gripped by the pipe handlers, the top drive is set down on the tool to a position near the upper limit of the float provided in set mode. Left hand torque is then applied and the setting nut, 108, rotated a sufficient number of turns to release the tool. The amount of rotation required to release will in general be equal to the number of turns required for setting.

Alternately, if the joint is to be made up after the tool is set, the joint weight may be supported by the tool while being positioned and stabbed into the connection to be made up. Once stabbed, and with the top drive is positioned to place the actuator sleeve, 109, at or near the lower limit of the 'float' provided in torque mode, the connection may be made up. As for break out, the tool is released by setting down the top drive to engage set mode and applying sufficient left hand rotation to release the tool.

FIG. 16 shows the tool in torque mode, set inside a tubular work piece 113 as it would appear while carrying hoisting load. Based on the teachings given herein describing the load transfer behaviour of the helical spring assembly interacting with the cage 103 and tubular work piece 113, it will be evident to one skilled in the art that loads (axial and torque) applied to the mandrel 104 with the tool set and in torque mode, are reacted in part into the tubular work piece by coupling through the helical spring assembly and in part through the upper and lower ends of the cage. The relatively stiff connection between the mandrel 104 and the helical spring element 106 provided by the lower spring end sleeve 105 ensures that only torque loads exceeding the frictional capacity of the interfacial region of contact between the helical spring element 106 and cage 103 tend to be transferred to lower splined connection between the cage 103 and mandrel 104. This greatly reduces the magnitude of cyclic torsional load transferred through the lower interval of the cage 103, and hence substantially improves its operational fatigue life. Axial hoisting load is reacted through the lower spring end sleeve 105 and if it exceeds the setting load tends to cause sliding in the interval of travel allowed by the lower splined connection between the mandrel 104 and the cage 103 which movement is evident as gap between the cage and lower spring end sleeve as shown in FIG. 16 and allows an increase in the radial pressure applied by the helical spring element 106 and hence the frictional lifting capacity of the grip assembly. This 'self energizing' tendency is highly valuable as a means to ensure sufficient frictional force is available to prevent slippage when hoisting. It will be further apparent that a portion of the axial load is reacted through the upper spring end sleeve 107 and into the top of the cage, 103, as tension, which tension for large lifting loads will tend to increase above that required for setting. However it will only tend to decrease significantly upon a substantial reduction in axial hoisting load due, to the reversal in direction the friction vectors must undergo when the direction of sliding is reversed. This behaviour has an advantageous effect on the fatigue life of the cage, 103, upper end similar to the manner in which the grip assembly responds to fluctuations in torque load.

Amoung other variables, the axial or torsional load required to initiate slippage is determined by the area in contact, the effective friction coefficient acting between the two surfaces, and the normal stress acting in the interfacial region between the cage, 103, and work piece. It will be further evident to one skilled in the art that to provide sufficient torque and axial load capacity, these variables may be manipulated in numerous ways including: lengthening the expanded interval of the grip; coating, knurling or otherwise roughening the cage exterior to enhance the effective friction coefficient; and increasing the axial stress that may be applied to the helical spring assembly.

It will be apparent to one skilled in the art, that as the helical spring element, 106, is compressed from the top, sliding resistance will tend to cause the axial and radial contact stress to decrease from top to bottom over the element length. It has been found in practice that lubrication of the contacting surfaces can be employed to reduce this effect if required to either improve the 'self starting' response or the relationship between setting torque and axial or torsional grip capacity.

The casing drive tool also provides a fluid conduit from the top drive quill into the tubular joint in which it is set. This is necessary in Casing Drilling™ applications where it is desired to apply fluid pressure or flow fluids into or out of the tubular work piece 113 and often occurs when running casing that must be filled from the top. In its preferred embodiment, the flow tube 112 connecting the internal bores of the cross over sub 101 and actuator sleeve 109, and the packer cup 110, support this function.

Alternative Embodiments

Sensors to provide measurements of torque and axial load may be incorporated into the actuator sleeve or other member of the load train or provided as separate devices and incorporated into the tool load train.

A hydraulic actuator may be used to provide the axial setting load on the helical spring element that causes expansion of the cage in place of the mechanical system of the preferred embodiment using a torque driven setting nut to apply the setting load.

A stronger yet still readily expandable cage wall may be constructed by joining at the ends two or more individual layers of coaxial close fitting thin wall tubes, each slit with interlocking tabs in the manner of the single wall cage described for the preferred embodiment.

In a further aspect of the preferred embodiment, we believe the helical spring element may be provided in two close fitting concentric layers having their helix angles wound in opposite directions, and the upper spring end sleeve keyed to the mandrel so that relative axial sliding movement is allowed but not rotation. This arrangement allows the helical spring elements to be loaded without contact between the edges of individual coils by reacting the torsion required to prevent edge contact under application of axial load. By adjusting the helix angle along the length of the helical spring element, this arrangement allows the relationship between axial load and radial pressure to be favourably adjusted to increase the overall grip capacity in a given length.

The method of internally gripping a work piece using a cage to enable torque and axial load transfer may be applied to applications where external gripping is required by inverting the grip architecture presented in the preferred embodiment. For such an inverted architecture the function of the mandrel is provided by a rigid outer sleeve, where the cage is coaxially positioned inside the outer sleeve and attached at one end, and the tubular work piece placed inside the cage. The helical spring element is disposed in the annular space between the mandrel and cage and means provided to activate the helical spring element with tension to cause the cage to contract inward and frictionally engage the outside surface of the tubular work piece with sufficient radial force to enable the mobilization of friction to transfer significant torque and axial load from the outer sleeve through the cage to the tubular.

What is claimed is:

1. An apparatus for handling tubular goods, comprising:

an elongate body having a coupling end adapted for mating engagement with a tubular good;

the coupling end including:

a structural member;

longitudinal strips joined at their opposed ends to form a flexible cylindrical cage coaxial with and connected to the structural member of the body;

at least one coaxial pressure member disposed in an annulus between the structural member and the cage, the pressure member being adapted to cause radial displacement of the cage, thereby exerting a gripping force to maintain the mating engagement between the tubular good and the coupling end enabling a transfer of force between the body and the tubular good.

2. The apparatus for handling tubular goods as defined in claim 1, wherein the structural member is a mandrel which, together with the cage and pressure member forms a male coupling.

3. The apparatus for handling tubular goods as defined in claim 1, wherein the cage being connected to the structural member by a connection which allows a limited range of relative axial movement between the cage and the structural member, such that axial load applied to the structural member loads the pressure member to increase the gripping force.

4. The apparatus for handling tubular goods as defined in claim 1, wherein the longitudinal strips of the cage having structurally interlocking edges, thereby increasing the torsion capacity of the cage.

5. The apparatus for handling tubular goods as defined in claim 1, wherein the pressure member includes a confined elastomer in combination with means to axially compress the confined elastomer to cause radial displacement.

6. The apparatus for handling tubular goods as defined in claim 5, wherein an axially movable setting member serves to axially compress the confined elastomer.

7. The apparatus for handling tubular goods as defined in claim 1, wherein the pressure member includes a confined cylindrical spring assembly in combination with means to axially load the cylindrical spring assembly to cause radial displacement.

8. The apparatus for handling tubular goods as defined in claim 7, wherein an axially movable setting member serves to axially load the cylindrical spring assembly.

9. The apparatus for handling tubular goods as defined in claim 1, wherein means is provided for coupling the body to a drive head.

10. The apparatus for handling tubular goods as defined in claim 1, wherein the body has an articulating coupling adapted for use in coupling the body to a hoist.

11. The apparatus for handling tubular goods as defined in claim 10, wherein the body is tubular and has a peripheral sidewall with a plurality of "L" shaped slots each having an axial leg and a circumferential leg, the articulated coupling including an insert positioned within the tubular body with radial pins that engage the slots, the pins being axially movable along the axial legs of the slots and being immobilized when in the circumferential legs of the slots.

12. The apparatus for handling tubular goods as defined in claim 1, wherein the body has supplemental lifting elevators.

13. The apparatus for handling tubular goods as defined in claim 12, wherein the supplemental lifting elevators include a sleeve having a first end and a second end, the first end being adapted to be secured to a top drive quill, the second end supporting a gripping assembly adapted to externally grip tubular goods.

14. The apparatus for handling tubular goods as defined in claim 1, wherein the cage has a friction enhancing tubular engaging surface.

* * * * *